US005495271A

United States Patent [19]

Koitabashi et al.

[11] Patent Number: 5,495,271

[45] Date of Patent: Feb. 27, 1996

[54] INK JET RECORDING APPARATUS THAT INDIVIDUALLY CONTROLS INK EJECTION FROM PLURAL RECORDING HEADS DURING A NON-RECORDING OPERATION

[75] Inventors: Norifumi Koitabashi; Haruo Uchida; Hiroshi Tajika; Hiromitsu Hirabayashi, all of Yokohama, Japan

[73] Assignee: Canon Kabushiki Kaisha, Tokyo, Japan

[21] Appl. No.: 26,102

[22] Filed: Mar. 1, 1993

Related U.S. Application Data

[63] Continuation of Ser. No. 524,489, May 17, 1990, abandoned.

[30] Foreign Application Priority Data

May 18, 1989 [JP] Japan ..... 1-122879
May 18, 1989 [JP] Japan ..... 1-122880

[51] Int. Cl.[6] ..... B41J 2/165

[52] U.S. Cl. ..... 347/23; 347/24

[58] Field of Search ..... 347/14, 23, 33, 347/24

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,459,600 | 7/1984 | Sato et al. | 346/140 |
| 4,463,359 | 7/1984 | Ayata et al. | 346/1.1 |
| 4,558,332 | 12/1985 | Takahashi | 346/140 R |
| 4,558,333 | 12/1985 | Sugitani et al. | 346/107 |
| 4,668,965 | 5/1987 | Tanaka et al. . | |
| 4,692,777 | 9/1987 | Hasumi | 346/140 R |
| 4,723,129 | 2/1988 | Endo et al. | 346/1.1 |
| 4,727,378 | 2/1988 | Le et al. . | |
| 4,740,796 | 4/1988 | Endo et al. | 346/1.1 |
| 4,745,414 | 5/1988 | Okamura et al. | 347/33 X |
| 4,967,204 | 10/1990 | Terasawa et al. | 347/23 |
| 5,018,884 | 5/1991 | Hirano et al. | 400/126 |

FOREIGN PATENT DOCUMENTS

| | | | |
|---|---|---|---|
| 0317267 | 5/1989 | European Pat. Off. . | |
| 0048551 | 4/1979 | Japan . | |
| 56847 | 5/1979 | Japan . | |
| 0078858 | 5/1984 | Japan | B41J 3/04 |
| 123670 | 7/1984 | Japan . | |
| 138461 | 8/1984 | Japan . | |
| 71260 | 4/1985 | Japan . | |
| 62-251145 | 10/1987 | Japan | 347/33 |
| 11350 | 1/1988 | Japan . | |
| 63-252748 | 10/1988 | Japan | 347/23 |
| 2169855 | 7/1986 | United Kingdom . | |

*Primary Examiner*—Benjamin R. Fuller
*Assistant Examiner*—David Yockey
*Attorney, Agent, or Firm*—Fitzpatrick, Cella, Harper & Scinto

[57] ABSTRACT

An ink jet recording apparatus, including a plurality of recording heads each having an ink outlet, a liquid passage communicating with the outlet and an ejection energy generating element for generating energy for ejecting ink through the outlet; a refresher for refreshing the ink in the passage by driving the ejection energy generating element to eject the ink when a recording operation of the apparatus is not performed; and a controller for changing a driving condition for the ejection energy generating element by the refresher for the recording heads.

14 Claims, 27 Drawing Sheets

INITIAL

PREPARATION

RECOVERY DURING RECORDING

RECORD END

LARGE SCALE RECOVERY

| | EX 1 | EX2 | EX3 |
|---|---|---|---|
| $N_A$ | 50 | 50 | 50 |
| $N_B$ | 50 | 60 | 100 |
| $N_C$ | 50 | 80 | 100 |
| $N_D$ | 100 | 100 | 100 |

INK JET RECORDING APPARATUS THAT INDIVIDUALLY CONTROLS INK EJECTION FROM PLURAL RECORDING HEADS DURING A NON-RECORDING OPERATION

This application is a continuation of application Ser. No. 07/524,489 filed May 17, 1990, now abandoned.

FIELD OF THE INVENTION AND RELATED ART

The present invention relates to an ink jet recording apparatus.

In an ink jet recording apparatus, the viscosity of the ink in an ejection outlet or a liquid passage communicating therewith is increased due to the evaporation of water content when the ink is not ejected for a long period of time in a particular ejection outlet or outlets depending on the data to be recorded or when the apparatus is not used for a long period of time. If the liquid passage becomes not proper for ejection due to the presence of the high viscosity ink, the quantity of the ink ejected varies even if the ejection energy generating element disposed in the passage is driven with the predetermined conditions. Therefore, the quality of the image recorded is degraded. The increase in the viscosity of the ink may result in improper ejection or ejection failure due to solidification of the ink.

Furthermore, in the ink jet recording apparatus, when the ink droplets, water droplets, dust or the like are deposited on the ejection side surface of the recording head in which the ejection outlets are formed, the ejected ink is pulled by the deposition with the result that the direction of the ejection changes, so that the image quality is degraded.

In order to remove the inconveniences attributable to the fact that the recording material is the liquid ink, the ink jet recording apparatus is equipped with peculiar mechanisms not seen in other recording apparatus, such as means for refreshing the liquid passage and for maintaining proper state of the ejection side surface, or another ejection recovery system for the recording head.

Various ejection recovery systems have been proposed. In one of the systems, the liquid passage is refreshed by driving the ejection energy generating elements during a period in which the recording operation is not performed to eject the ink to an ink receptor (preliminary ejection or idle ejection). In other systems, the ink supply system is pressurized, or the ink is sucked from the ejection outlets, by which the ink is discharged forcedly through the ejection outlet.

In a further system, the ejection outlet formed surface is refreshed to prevent variation of the ink ejection direction by the provision of a wiping member contactable to the ejection side surface, and a relative movement is imparted therebetween to remove the ink droplet and the dust deposited adjacent to the ejection outlet (wiping). GB2, 169,855A which has been assigned to the assignee of the present application proposes that the idle ejection condition is changed in accordance with the state under which the ink jet head is used, more particularly, in accordance with the ambience between the initial stage and during the recording.

The present invention is aimed at improving the ejection recovery system (suction recovery (ejection recovery or the like)) for refreshing the liquid passage. It is a principal object of the present invention to provide an ink jet recording apparatus wherein a plurality of the recording heads are used, and wherein the conditions under which the idle ejection recovery processing is properly determined for the plural recording heads, by which the recording heads can be maintained properly with a degree of certainty.

It is a further object of the present invention to provide an ink jet recording apparatus in which the ejection recovery system for refreshing the liquid passage is further improved, and wherein the conditions under which the forced processing operation is performed are determined on the state of the recording head, by which the recording head can be maintained in good condition with a degree of certainty.

According to an aspect of the present invention, there is provided an ink jet recording apparatus including a plurality of recording heads each having an ejection outlet, a liquid passage communicating with the ejection outlet and an ejection energy generating element disposed in the passage for producing the energy used for the ejection of the ink, means for refreshing the liquid passage by actuating the ejection energy generating element to eject the ink during a period in which the recording operation is not performed, and means for adjustably setting the actuation or drive conditions of the ejection energy generating element, corresponding to the plural recording heads.

According to an embodiment of the present invention, the refreshing operation, preferably idle ejection, is effected with a proper quantity of the ink determined in accordance with various conditions which are different among the plural recording heads. For example, when plural recording heads having different color ink materials, are sequentially wiped, the recording head which is wiped at a later stage may be subjected to mixture of ink with the ink of the recording head which has been wiped earlier. In the recording head using the ink having a high lightness (i.e., a lighter shade); is more conspicuous in the mixture of the color with low lightness (i.e., a darker shade) ink. Therefore, the quantity of the ink discharged by the idle ejection is made larger in such a recording head or heads. By doing so, as compared with the case wherein the same quantities of the ink are ejected, the liquid passage can be assuredly refreshed, and the total amount of ink consumption can be saved. The present invention, however, is not limited to this particular embodiment.

When the ejection recovery process is performed in which the ink is forcedly discharged through the ejection outlets by pressure to refresh the liquid passages in accordance with the present invention, it is preferable that the pressure and/or the pressure application period is changed in accordance with the conditions of the recording head at the time of the recovery process start. For example, when the processing is started after a predetermined degree of the recording operations, the ink in the liquid passages in the recording head has a relatively high temperature, and therefore, a relatively low viscosity, and therefore, the pressure applied is set to be lower (lower vacuum in the case of the sucking through the ejection outlets), or the pressure application period is made shorter. By doing so, the ink is discharged at a low speed, and therefore, the flow of the ink is stabilized so that fine bubbles or the like in the liquid passage are removed with the flow of the ink. Or, the consumption of the ink during the forced discharge can be reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in detail in conjunction with the accompanying drawings.

Figure 1:
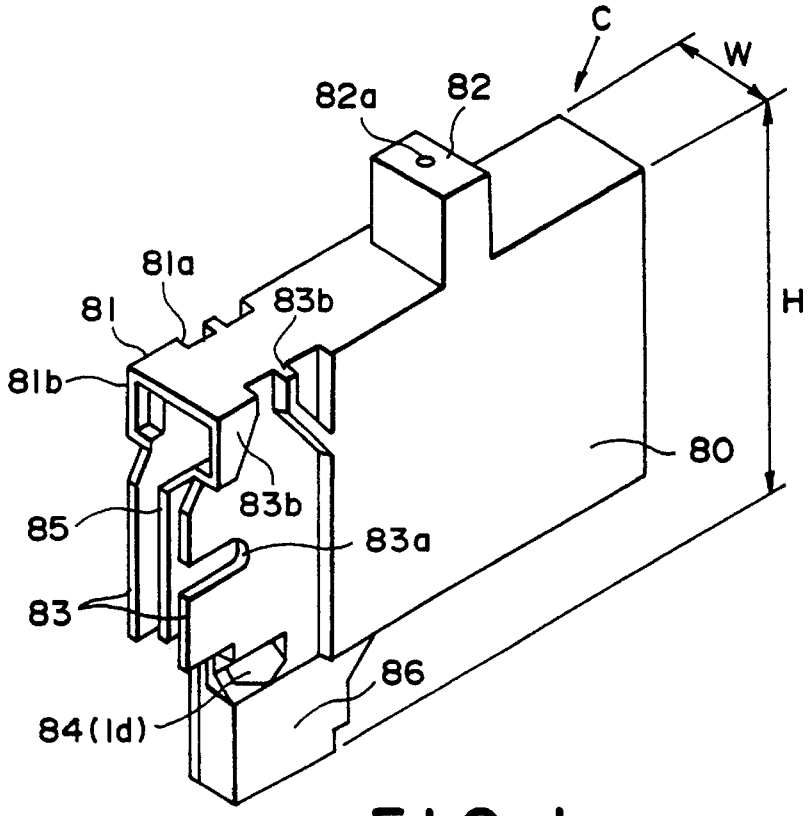
FIG. 1 is a perspective view of a cartridge containing a recording head and an ink container as a unit used in an ink jet recording apparatus according to an embodiment of the present invention.

(1) Cartridge:

Referring to FIG. 1, there is shown an example of a cartridge C which is mountable on a carriage (which will be described in detail in conjunction with FIG. 3 hereinafter) of the ink jet recording apparatus according to an embodiment of the present invention.

The cartridge C in this example includes an ink container at an upper position and a recording head 86 at a lower position. The cartridge C further includes connectors 85 along the ink container 80 for receiving signals for driving the recording head and transmitting output representative of the ink remaining amount detection. Therefore, when the cartridge C is mounted on the carriage which will be described hereinafter, the height H is low. By reducing the thickness W measured in the cartridge scanning movement direction, the size of the carriage may be made smaller when the cartridges C are disposed together, as will be described hereinafter in conjunction with FIG. 2.

The cartridge has connector covers 83 integrally extended from the outer wall of the container. The connector covers are effective to prevent inadvertent contact to the connector 85. A positioning portion 81 has two abutment surfaces 81*a* and 81*b* in two directions. By providing a sufficient distance between the positioning portion and a positioning abutment surface on the recording head 86, the recording head is assuredly positioned correctly by the urging toward the tapered surface 84 by a pressing pin. A grip 82 is used when the cartridge C is mounted to or dismounted from the mount. In the grip 82, a vent 82*a* is formed for communication between the inside of the ink container 80 with the ambience. A cut-away portion 83*a* and a guide 83*b* function as a guide when the cartridge C is mounted to a mounting portion.

The recording head 86 is provided with plural ejection outlets formed at the bottom (as seen in FIG. 1) side of the cartridge. In the liquid passages communicating with the ejection outlets, there are disposed ejection energy generating elements for generating energy used for ink ejection. As for the ejection energy generating elements, it is preferable that thermal energy generating elements are used, since then the ejection outlets and/or the liquid passages can be produced at high density.

Figure 2A:
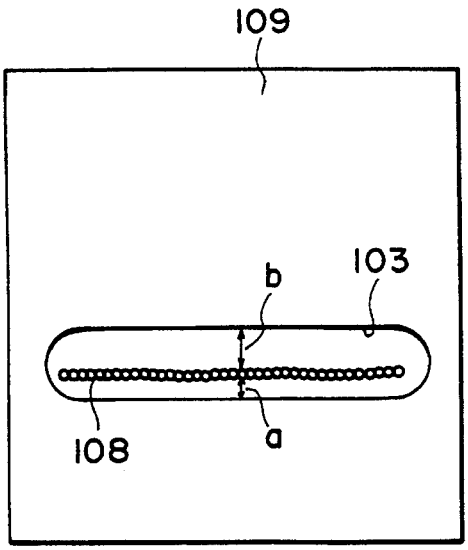
FIGS. 2A and 2B are front and side sectional views of the recording head.
Figure 2B:
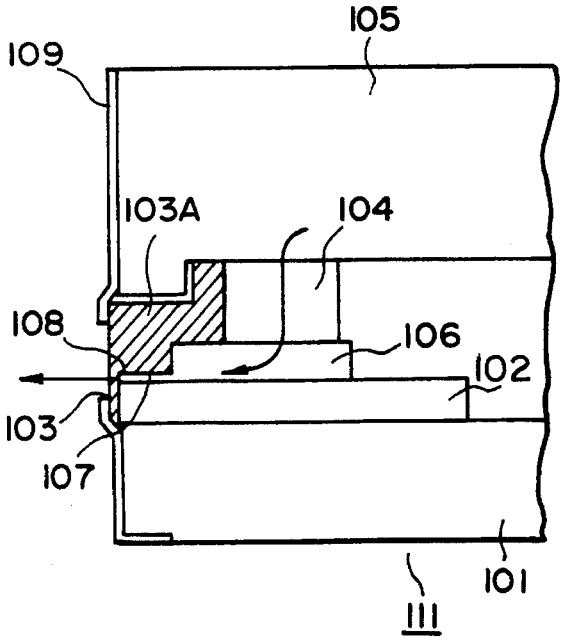

FIG. 2A is a front view of the recording head 86 seen from the ink ejection side, and FIG. 2B is a side sectional view. A base plate 101 of the recording head 86 is made of aluminum. On the base plate 101 a heater board 102 made of Si or the like is bonded. On the surface of the heater board 102, electrothermal transducers (not shown) (thermal energy generating elements) and diodes (function elements for driving the electrothermal transducers), or the like are formed. An orifice plate 103 in which the ejection outlets are formed is molded integrally with a top board 103A having a groove for establishing the ink liquid chamber.

The ejection outlets in the orifice plate 103 may be formed with high accuracy using application of an excimer laser beam, for example, and using photoetching process, by which highly accurate configurations can be provided for all of the number of ejection outlets. When different materials are exposed at the ejection side surface, the orifice plate 103 is used to prevent the variation of the ejection direction attributable to the difference in the wettability between these materials.

A filter 104 is disposed in an ink supply passage between a chip tank 105 to a common chamber 106. The filter 104 is effective to remove foreign matter or the like in the ink flowing in the direction indicated by an arrow. The ink having passed through the filter 104 reaches the common chamber 106, from which the ink is supplied to the ink passages 107 communicating with the common chamber 106 in response to the ejection through the passages. A confining member 109 functions to confine by its resilient force the orifice plate 103 to press-contact it to the opening side surface (an end surface of the heater board 102, in this example). In this embodiment, the confining member 109 is made of stainless steel.

With the above-described structure, ink is supplied to the chip tank 105 from the ink container 80 integral with the recording head 86. Thereafter, the ink flows as indicated by the arrow. By the passage through the filter 104, the foreign matter or the like in the ink is removed from the ink. Then, the ink reaches the common chamber 106 and is led to the liquid passage 107. By driving the electrothermal transducers disposed in the liquid passages 107, bubbles are formed in the ink in the respective passages, and by the production of the bubbles, the ink is ejected through the ejection outlets 108.

Figure 3:
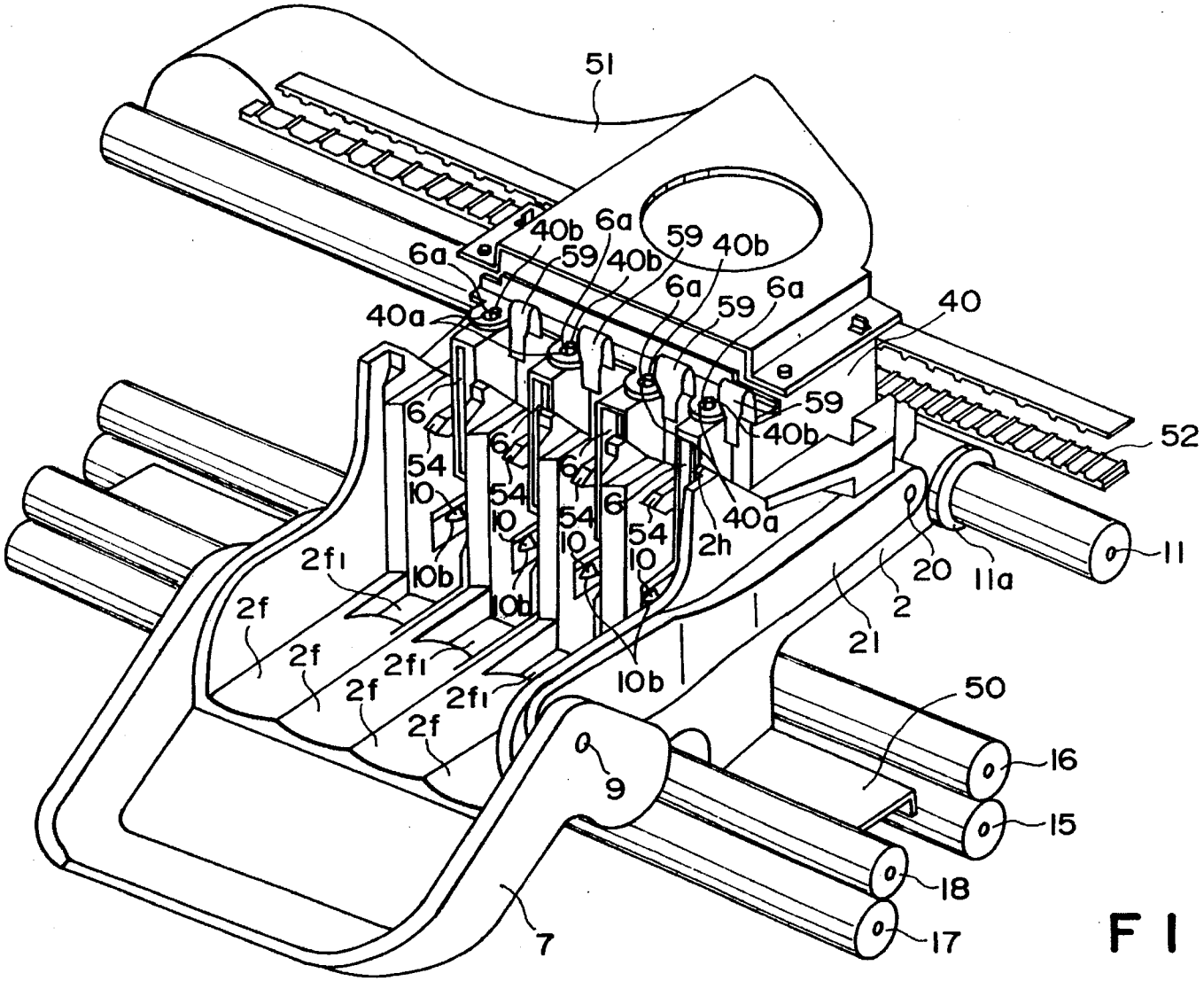
FIGS. 3 and 4 are perspective and top plan views of the structures around a carriage on which the cartridge of FIG. 1 is mounted in the apparatus according to the embodiment.
Figure 4:
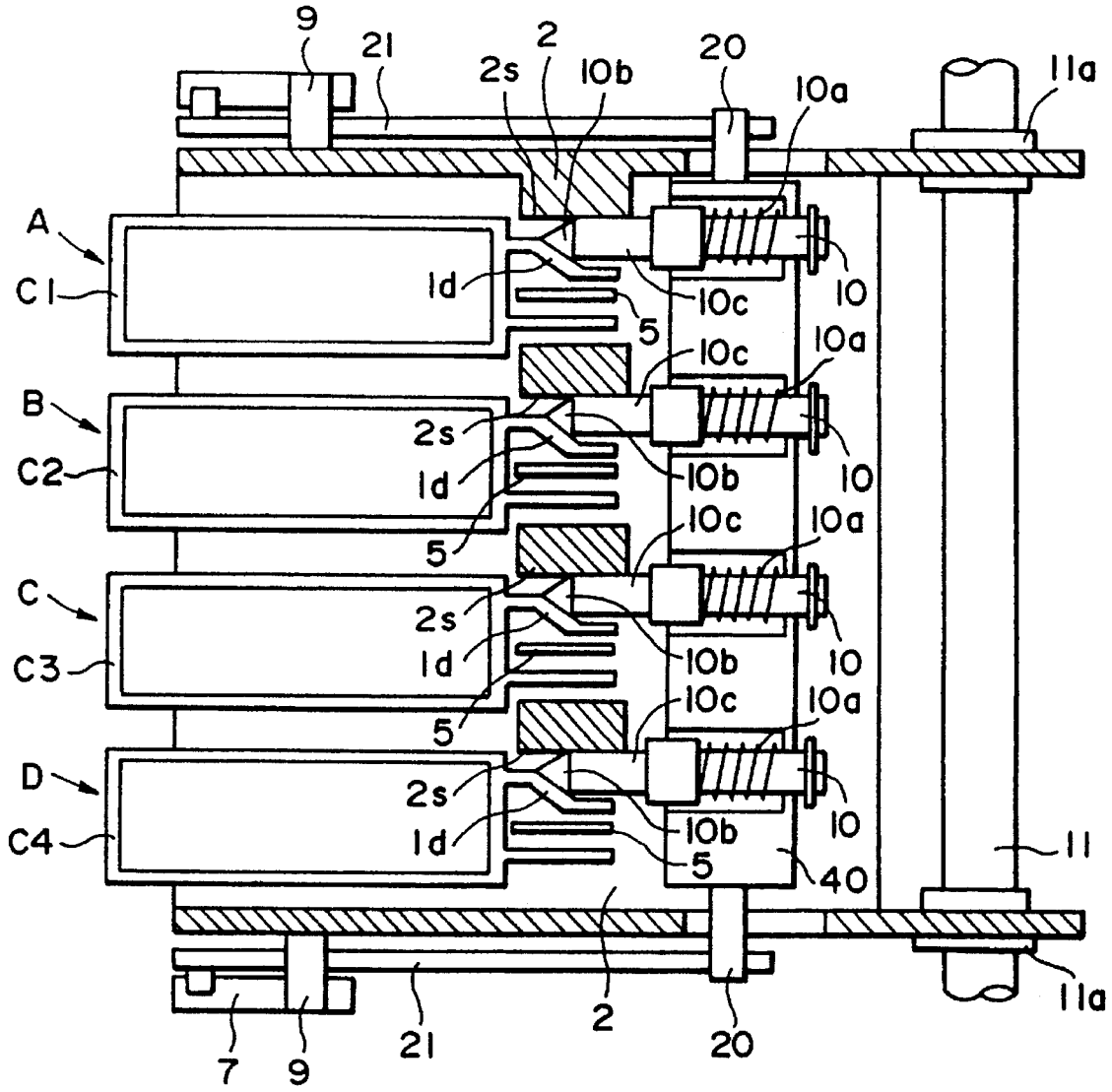

(2) Carriage:

FIGS. 3 and 4 are a perspective view and a top plan view of a carriage of an ink jet recording apparatus to which the cartridge C shown in FIG. 1 can be mounted. In this Figure, four cartridges C1, C2, C3 and C4 are shown as being positioned and mounted on the carriage 2, the cartridges containing different color ink materials such as yellow ink, magenta ink, cyan ink and black ink.

On a connector holder 40 functioning as a holding member, four pressing pins 10 (pressing pins A, B, C and D), which are urged to the left in FIG. 4 by springs 10*a* (springs A, B, C and D). The connector holder 40 is engaged with links 21 (link I and link II) through shafts 20 (shaft I and shaft II). In accordance with the rotation (clockwise direction, counterclockwise direction) of the operation lever 7 engaged with the link 2, the connector holder 40 is movable to the left and right in FIG. 4. When it is moved to the right, the pressure is released to permit exchange of the cartridge. When, on the other hand, it is moved to the left, the mounting of the cartridge is permitted.

When the cartridge C is mounted on a mount 2*f*, the recording head 86 of the cartridge C is inserted down from the above into a recess 2*fl* of the mount 2*f*. At this time, a rectangular portion 2*h* of the carriage 2 is engaged between the guides 83*b* of the cartridge C, by which the cartridge C is generally positioned correctly. When the operation lever 7 is rotated in the clockwise direction about a shaft 9, the holder 40 is advanced by which a guide 54 of the carriage is inserted into the cut-away portion 83*a* of the cartridge C, and the pin 10 is engaged with the cartridge C, so that the cartridge C is correctly mounted on the cartridge mount 2*f*. A spring 59 is provided on the carriage to urge the cartridge C mounted on the mount 2*f* rearwardly to improve the positioning accuracy. An end 10*b* of the pin 10 is abutted to the abutment surfaces 1*d* of the four cartridges C to urge the cartridge. Outer peripheral surface 10*c* of the pin 10 contacts the abutment surface 2S of the carriage 2 so as to receive the thrust force in the direction perpendicular to the axis of the pin, independently. Therefore, the holding member 40 receives only the reaction force from the spring 10*a* (A, B, C and D), free from the thrust force. Therefore, the plural cartridges may be released simultaneously, and the releasing lever 7 can be operated with small force upon the mounting or dismounting operation.

The description will be made as to the mechanism and the operation for the engagement and disengagement between the head connector 85 of the cartridge C and a main assembly connector 6 of the main assembly of the apparatus.

Figure 5:
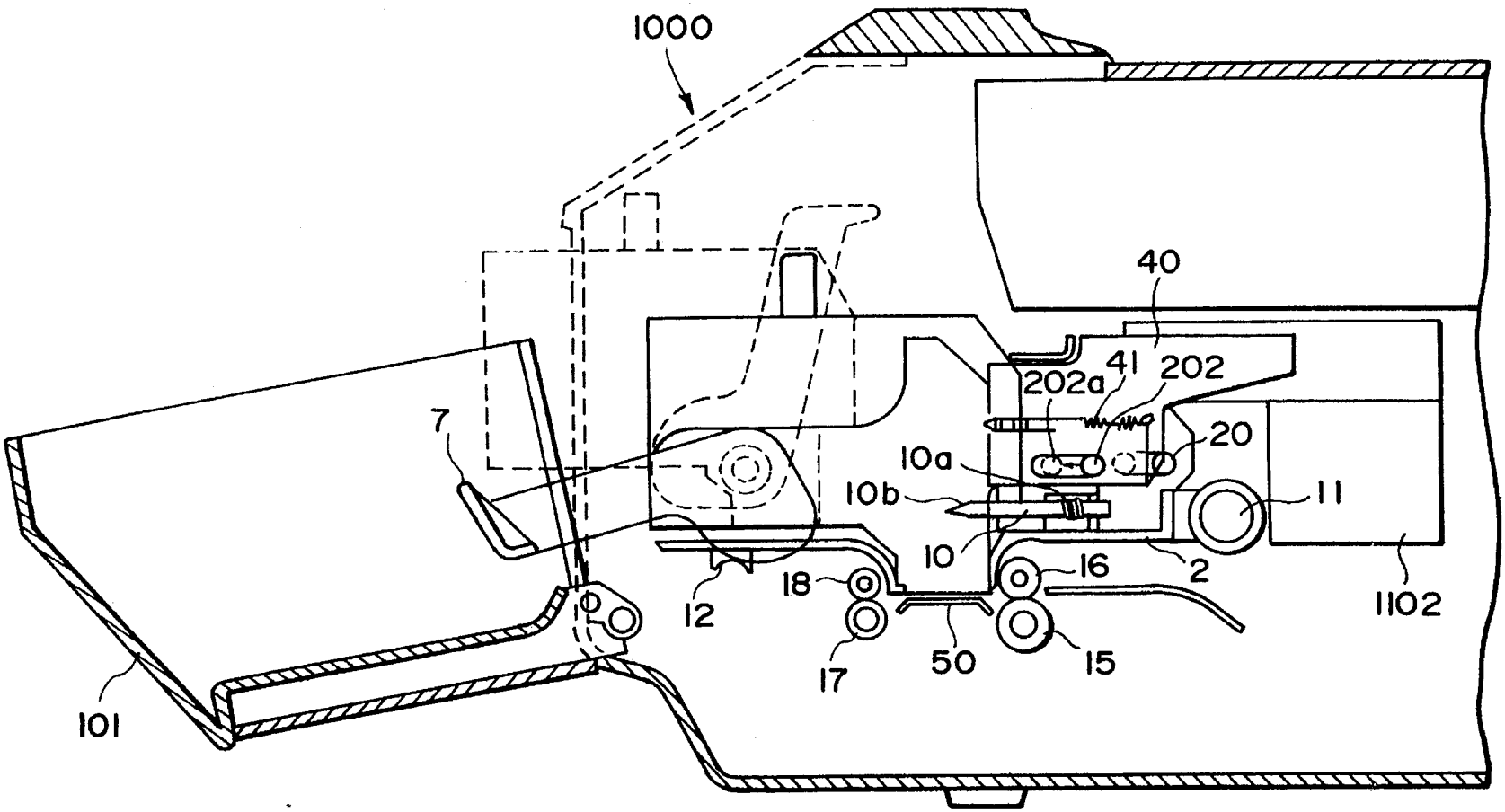
FIGS. 5 and 6 are sectional views of a copying machine as an exemplary apparatus according to this embodiment of the present invention.

When the main assembly connector 6 is to be inserted into the head connector 85, the lever 7 is operated when an engaging shaft 6*a* integral with the main assembly connector 6 is kept engaged with an engagement portion 40*b* of the connector holder 40 by the resilient force of the tension spring (FIG. 5). By this, the main assembly connector 6 and the connector holder 40 are moved together. Then, the head connector 85 which is generally positioned by the cartridge C being mounted on the mount 2*f* of the carriage is faced to the main assembly connector 6 which is generally positioned by engagement between the engaging shaft 6*a* and the engaging portion 40*b*. Then, it is guided by a slanted surface (not shown) of the main assembly connector 6 until the main assembly connector 6 is engaged (joined) with the head connector 85. Thereafter, the connector holder 40 is moved to the right through a predetermined distance, toward the rear side in FIG. 3. The movement is caused by the rotation of the lever 7. Here, the predetermined distance is a distance sufficient for the engaging shaft 6*a* to be away from the engaging portion 40*b*, or the movement distance of the connector holder 40 to place the main assembly connector 6 from the positioned state to a movable (released) state.

The main assembly connector 6 is engaged with the head connector 85 with the force stronger than that provided by the tension spring 41, so that the main assembly connector 6 is released from the connector holder 40, that is, the engagement therebetween is released. A large diameter portion of the engaging hole 40*a* is larger than the diameter of the engaging shaft 6*a* of the main assembly connector 6 with the result of a gap therebetween. Therefore, when the main assembly connector 6 and the head connector 85 are engaged (joined) together, the main assembly connector 6 is free from the connector holder 40, and therefore, the cartridge C is positioned relative to the carriage 2 only by the urging force provided by the pin 10, by which the correct positioning of the recording head 86 relative to the carriage 2 is assured.

When the cartridge C is to be dismounted, the lever 7 is rotated counterclockwise from the up-right position to the laid-down position (FIG. 3 position). Then, the engaging shaft 6*a* having been engaged with the head connector 85 with the strong force abuts the large diameter portion of the engaging hole 40*a* when the connector holder 40 moves to the right. The main assembly connector 6 is released from the head connector 8 with the engaging shaft 6*a* being pressed to the rear in FIG. 3. Simultaneously, the pin 10 and the connector holder 40 move as a unit to be away from the recording head 86.

In FIGS. 3 and 5, a scanning rail 11 extends in the main scanning direction of the carriage to support slidably the carriage 2. Reference numerals 11*a*, 51 and 52 designate a bearing, a flexible cable for communication with the cartridge C through the connector and a belt for transmitting a driving force for reciprocal movement of the carriage 2. A pair of rollers 17 and 18 and a pair of rollers 15 and 16 are disposed beforehand after the recording position by the recording head 86 to convey the recording medium. A platen 50 functions to provide the flat surface of the recording medium.

(3) General Arrangement of the Recording Apparatus:

FIG. 5 shows a general arrangement of the recording apparatus such as a printer, copying machine or a facsimile machine employing the structures described in the foregoing. A main assembly 1000 of the recording apparatus is provided with a cover 1101 openable toward the operator. When the cover 1101 is opened by rotation about a shaft, the inside of the apparatus can be accessed. By the opening, the lever 7 is permitted to rotate, and the mounting or dismounting operation of the cartridges C1–C4 relative to the main assembly is also permitted. The position of the lever 7 indicated by the solid line is the position for permitting the mounting of the cartridge shown in FIG. 1. At this position, the movement of the cover 1101 to the closed position is prevented. The cartridge indicated by the broken lines is shown as being in the process of the mounting operation. The cartridge indicated by the solid lines is at the correct operating position of the main assembly where it is possible to perform the recording operation. The surface of the recording head 86 of the cartridge in which the ejecting outlets are formed are faced in parallel to a guiding surface of the platen 50, and the recording head is projected below the carriage and is disposed between the conveying rollers 16 and 18. Reference numeral 1102 designates a flexible sheet of the electric wiring, and 12 designates a rail for supporting and guiding the carriage 2 in cooperation with the rail 11.

The connector holder 40 is shown as when the cartridge is mounted, and thereafter, the lever 7 is rotated to the broken line position by which the mounting of the cartridge to the carriage is completed. Shafts 20 and 202 are disposed at both sides with respect to the relative movement direction between the connector holder 40 and the carriage, and they are at the same level. These shafts are cylindrical and movable in two elongated bores having a central long shaft on a line at the both sides of the carriage. The shafts 20 and 202 correspond to the lever 7 indicated by the solid lines. The shafts 20 and 202 are effective to further assure the parallel movement of the connector holder. In this example, the shafts 20 and 202 are mounted not on the connector main assembly, and are disposed above and adjacent to the recording head positioning pin, and therefore, the positional accuracy of the recording head positioning pin 10 is improved. It is possible that shafts which are similar to the shafts 20 and 202 are mounted on the connector main assembly to stabilize the parallel movement of the connector main assembly and to provide the flexibility in the to-and-fro movement and the movement to the left or right within the clearance formed with the side plate after the connector is joined. In this embodiment, it is preferable that the elongated bore for the shaft 202 is such that after the connector main assembly is joined, the shaft 202 is not fixed in the to and fro direction, and the positioning by the pin 10 acts substantially only on the shaft 20.

Figure 6:
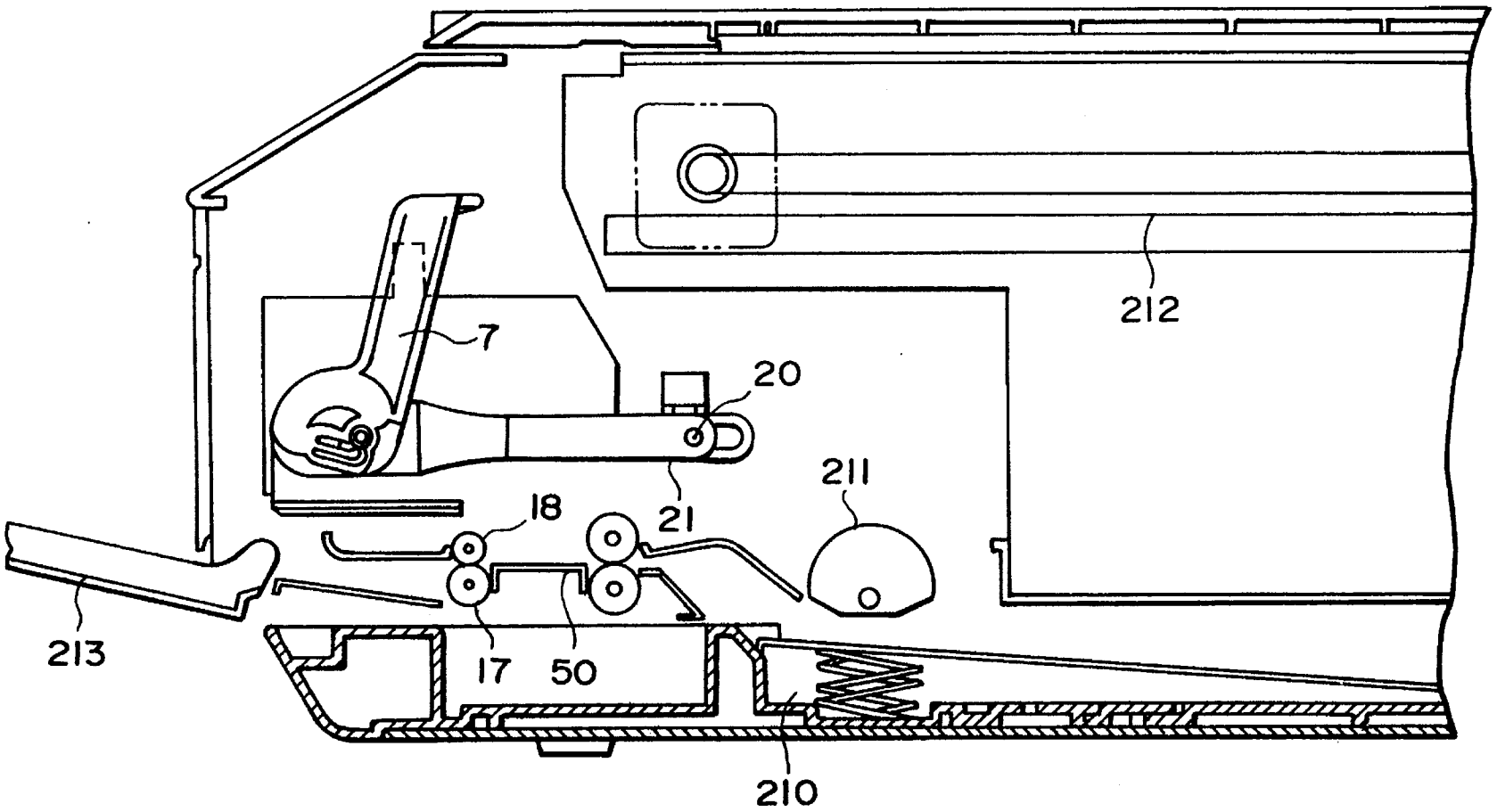

FIG. 6 is a side view illustrating the engaging relation between the lever 7 and the shaft 20, and corresponds to a side view of the device shown in FIG. 4. Described with FIG. 4, the link 21 connects the lever 7 and the shaft 20. In this Figure, the main assembly is a copying machine. It comprises an upper original holding cover, an optical system disposed below an original supporting platen to read the original, and means 212 for converting the read information to an electric signal. The signal is converted to a recording head driving signal through the flexible sheet 1102 to form a full color ink image. A cassette 210 is inserted at the lower portion of the main assembly from the discharge tray 213 side to feed the recording medium in the direction opposite to the inserting direction. A feeding roller 211 is disposed corresponding to the recording material discharging portion of the cassette.

(4) General Arrangement of the Recovery System Unit:

The description will now be made as to the recovery system unit in this embodiment.

Figure 7:
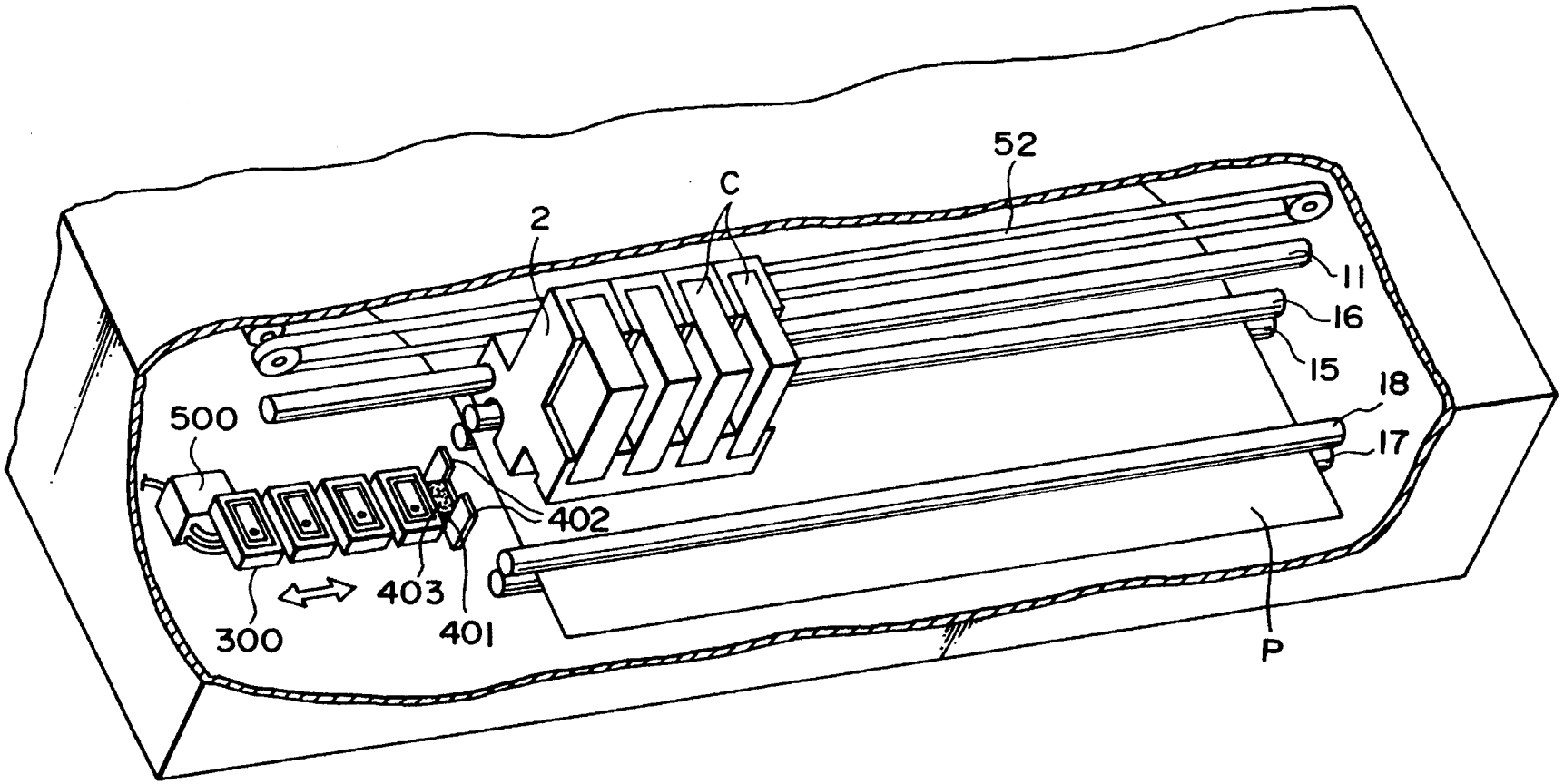
FIG. 7 is a somewhat schematic perspective view of a recovery unit in the embodiment of the present invention.

FIG. 7 is a perspective view illustrating the general arrangement and the position of the recovery unit. In this embodiment, the recovery unit is disposed at its home position which is at the left side in FIG. 3.

The recovery unit comprises a cap unit for each of the cartridges C each having the recording head 86. The cap unit 300 is slidable to the left and to the right together with movement of the carriage 2 and is movable up and down. When the carriage 2 is at the home position, it is connected with the recording head 86 to cap it. The detailed structure of the cap unit 300 will be described hereinafter in conjunction with FIGS. 8 and 9.

The recovery unit further comprises a first and second blades 401 and 402 functioning as wiping members, a blade cleaner 403 made of liquid absorbing material, for example, to clean the first blade 401. In this embodiment, the first blade 401 is supported on a blade moving mechanism driven by movement of the carriage 2 in substantially the vertical direction, so that the first blade 401 can be set at a projected (raised) position for wiping the surface of the orifice plate 103 of the exposed surface of the ejection side of the recording head 86 and at a retracted (lowered) position away from the surface. In this embodiment, the recording head 86 is so positioned that the portion having the width b in FIG. 2A is at the left side in FIG. 7, and it is wiped by the first blade when the carriage 2 moves from the left to the right. By doing so, the exposed surface of the orifice plate 103 is wiped only in the direction from the narrow side (the side portion having the width a) defined by the ejection outlets to the wider side (the side having the width b). The moving mechanism and the operation for the first blade 401 will be described hereinafter in conjunction with FIG. 8, 10–12. The second blades 402 are disposed at such positions to wipe the portion of the ejection side surface of the recording head not wiped by the first blade 401, that is, the surface of the confining member 109 present at both sides of the orifice plate exposed as shown in FIG. 2A.

The recovery unit has a pump unit communicating with the cap unit 300 to produce vacuum in the sucking process in which the cap unit 300 is coupled with the recording head 86. The structure and the operation of the pump unit 500 will be described hereinafter in conjunction with FIGS. 8 and 13.

Figure 8A:
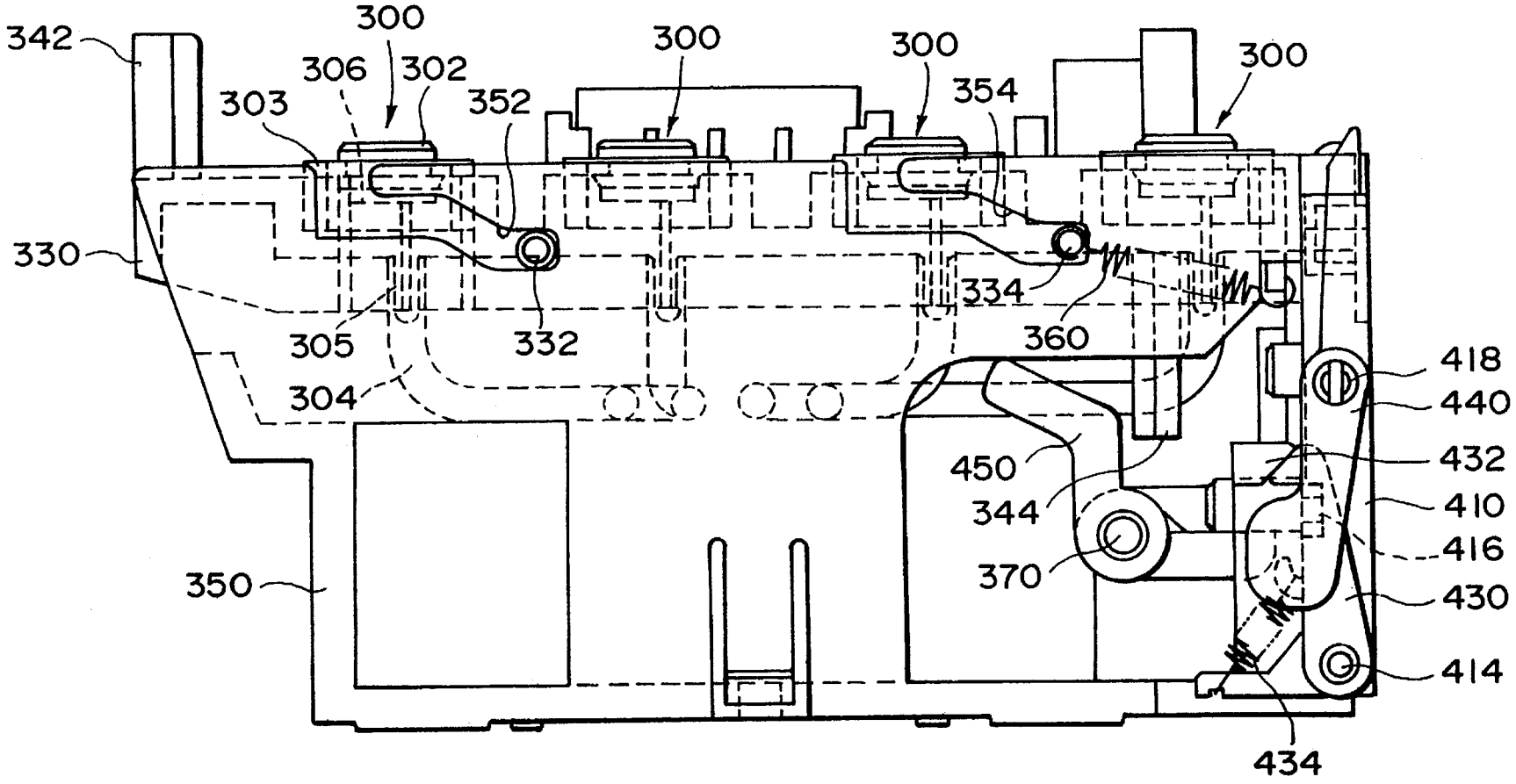
FIGS. 8A, 8B and 8C are front, top plan and side views showing detailed structures of the recovery unit.
Figure 8B:
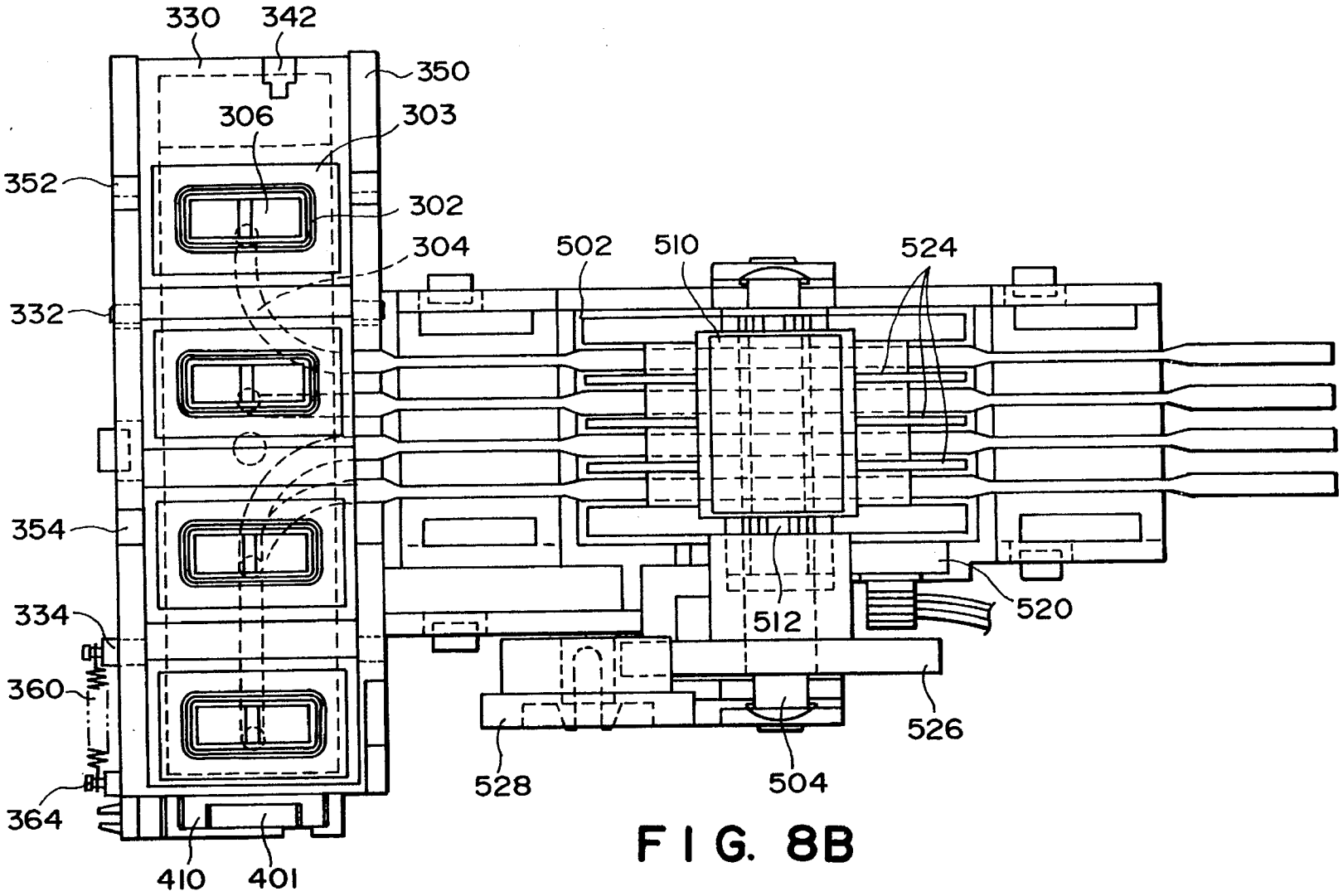
Figure 8C:
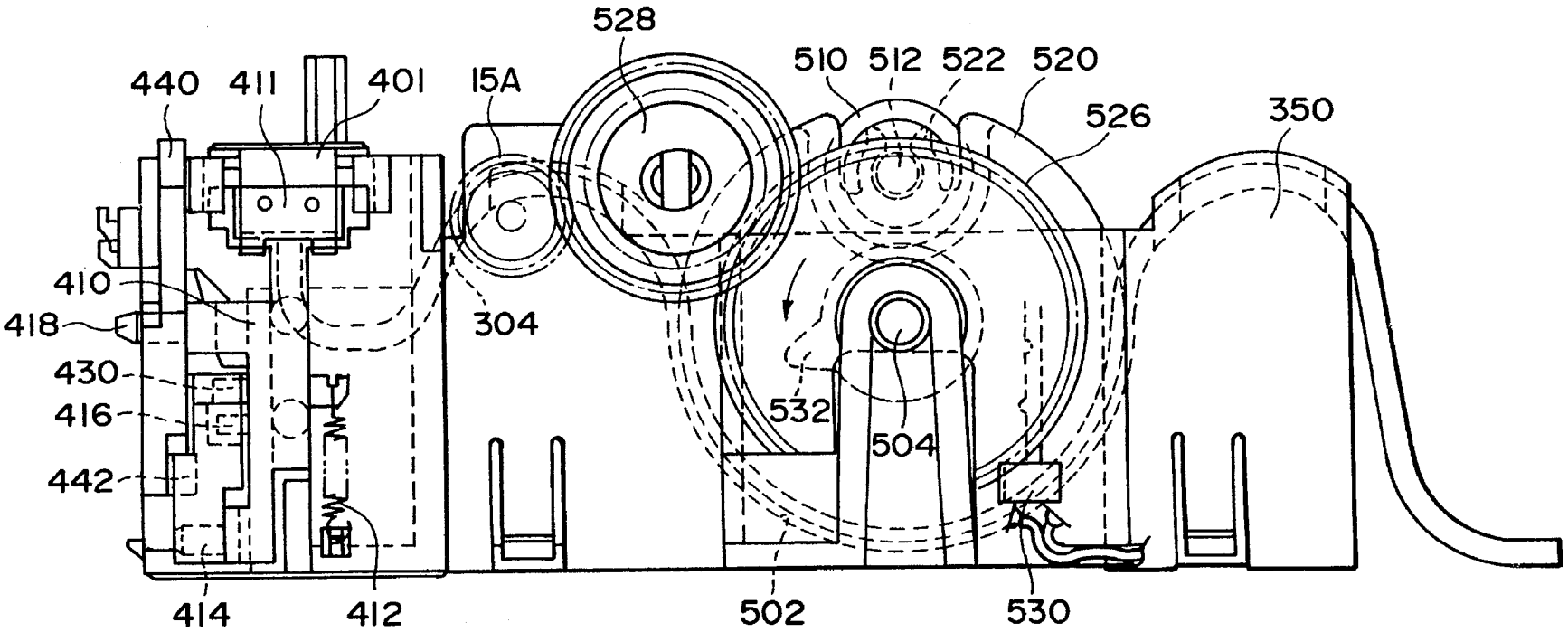

(4.1) Cap Unit:

FIGS. 8A, 8B and 8C are a front view, a top plan view and a side view illustrating the detailed structure of the recovery unit. The cap unit 300 includes a cap 302 contactable to the recording head 86 around the ejection outlets, a holder for supporting the cap 302, an absorbing member 306 for receiving and accommodating the ink ejected by the idle ejection process and the sucking process, a sucking tube 304 for sucking the ink received by the absorbing material 306, and an integral pipe 305 communicating with the pump unit 500. The number, the same as the number of cartridges C (four in this embodiment), of the cap units 300 are provided corresponding to the respective cartridges C and are supported by the cap holder 330. Pins 332 and 334 are projected from the cap holder 330, and are engaged with cam grooves 352 and 354 formed in a fixed recovery unit base 350 to guide the cap holder 330 in the left-right direction and up-down direction in FIG. 8A. A spring 360 is stretched between one of the pin 334 of the cap holder 330 and a raised portion 364 of the recovery unit base 350, by which the cap holder is normally urged to a low right end position shown in this Figure. The position where the recording head 86 of the cartridge C mounted on the carriage 2 is faced to the cap holder 330 or the cap unit 300 disposed at the above position, is the start position SP of the carriage 2 for the one scan recording operation.

An engaging portion 342 is raised from the cap holder 330 to be engaged with the carriage 2 at a position left side of the start position. When the carriage 2 moves further to the left from the start position (FIG. 8A, the cap holder 330 moves by the engaging portion 342 against the spring force of the spring 360). At this time, the cap holder 330 is guided through pins 332 and 334 along the cam grooves 352 and 354 to displace to the left and upwardly. Therefore, the cap 302 is press-contacted to the recording head 86 around the ejection outlets, so that the recording head 86 is capped. The position where the recording head 86 is capped is the home position of the carriage 2.

Figure 9A:
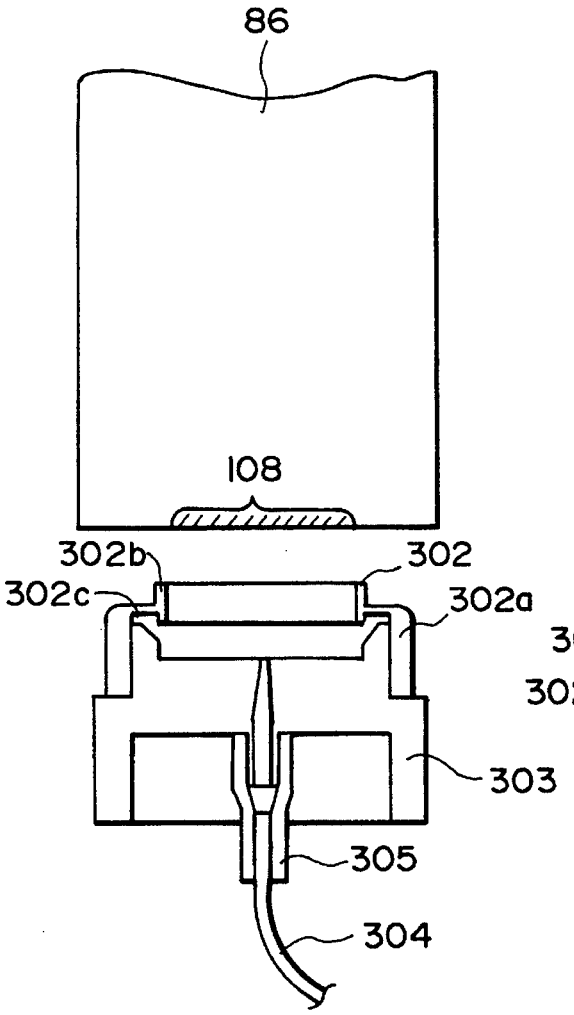
FIGS. 9A, 9B are front views illustrating detailed structures and operation of a cap unit of the recovery unit.
Figure 9B:
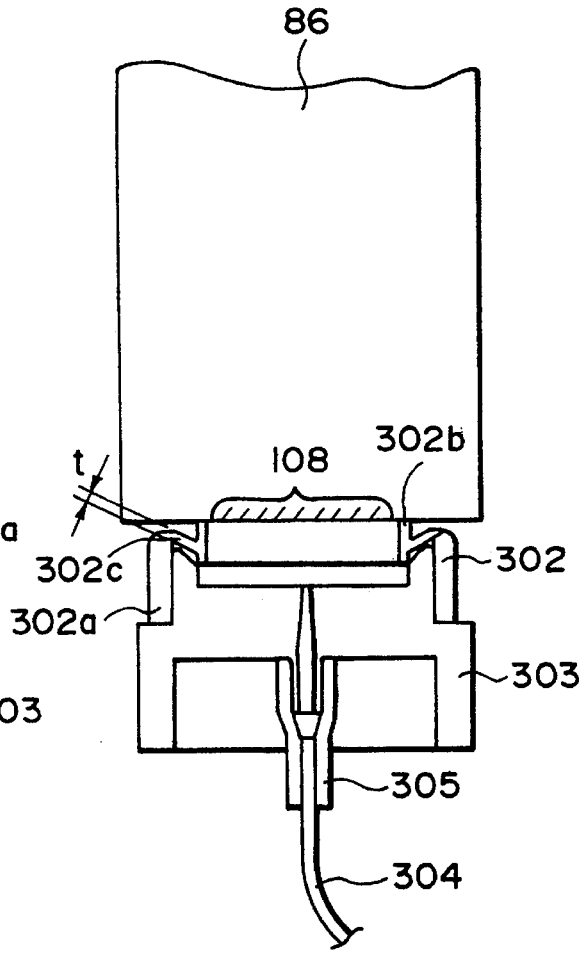

Referring to FIGS. 9A and 9B, the description will now be made as to the structure and the operation of the cap unit 300 in this embodiment. In these Figures, the absorbing material 306 is omitted for simplicity.

The cap 302 is made of an elastic material and comprises a fixing portion 302*a* for being fixed to the holder 303, an annular portion 302*b* and edge portion 302*c* for stretching the annular portion in the fixing portion 302*a*. These portions are integrally molded.

The cap 302 is made of, for example, silicone rubber, butyl rubber or another elastic material.

By minimizing the thickness t of the edge portion 302*c* shown in FIG. 9B, the conformability of the cap 302 to the ejection side surface of the recording head is improved. The thickness t of the edge portion 302*c* is preferably not less than 0.4 mm and not more than 1 mm.

The annular structure or portion 302*b* of the cap 302 exhibits the elasticity in the direction of abutment of the ejection outlet closing means to the ejection side surface. Using the elasticity, the cap is conformed with the ejection side surface of the recording head. The cap unit 300 is brought into contact with the ejection side surface (movement from FIG. 9A position to the FIG. 9B position) by the movement of the cap holder 330 relative to the recovery unit base 350. At this time, the contacting action is effected while the backside of the integral tube 304 communicates with the ambience. By doing so, even if the size of the space in the cap is reduced, the ambient pressure is maintained within the cap, so that the meniscus of the ink in the ejection outlet does not retract.

When the cap is to be disengaged, as will be understood from comparison between FIGS. 9A and 9B, the size of the space has been significantly reduced upon the contacting action of the cap 302 to the recording head 86. Therefore, a pumping action (vacuum) occurs by the resiliency of the cap upon the disengaging operation, and therefore, the ink is retained in the cap. This is because the contracted cap restores upon the disengagement thereof from the recording head. When the cap is disengaged, the pressure in the cap changes from vacuum to the ambient pressure, and therefore, the ink is prevented from spilling from the cap, so that the ink can be continuously retained in the cap. This function is enhanced by the provision of the cavity provided in the holder 303 right below the cap.

(4.2) Blade Moving Mechanism and Others:

The description will be made as to the moving mechanism for the first blade 401. Referring back to FIGS. 8A, 8B and 8C, a blade holder movable in the substantially vertical direction is designated by a reference 410. It is mounted to the first blade 401 by a mounting device 411. A holder restoring spring 412 urges the blade holder 410 downwardly.

A locking lever 430 is rotatable about a pin 414 projected from the blade holder 410 and is effective to lock the blade holder 410 at an upper position by engagement with the top surface of the stopper 432. It is normally urged in the counterclockwise direction in FIG. 8A by a spring 434. In the state shown in this Figure, it is engaged with a portion 416 projected from the blade holder 410 and is retained at the position shown in the Figure.

A releasing lever 440 is rotatably mounted on a pin 418 projected from the blade holder 410 and is effective to the locking state of the locking lever 430 at the upper position of the blade holder 410. It releases the locking lever 430 by its counterclockwise rotation in FIG. 8A. More particularly, the releasing lever 440 is provided with a pin 442 projected therefrom for engagement with the locking lever 430. When the releasing lever 440 rotates about the pin 418 in the counterclockwise direction, the pin 442 rotates the locking lever 430 about the pin 414 to release the engagement between the locking lever 430 and the top surface of the stopper 432.

A cam member 450 is effective to transmit the driving force to raise the blade holder 410 in association with movement of the carriage 2, and is supported for rotation on the pin 370 projected from the recovery unit base 350.

Figure 10:
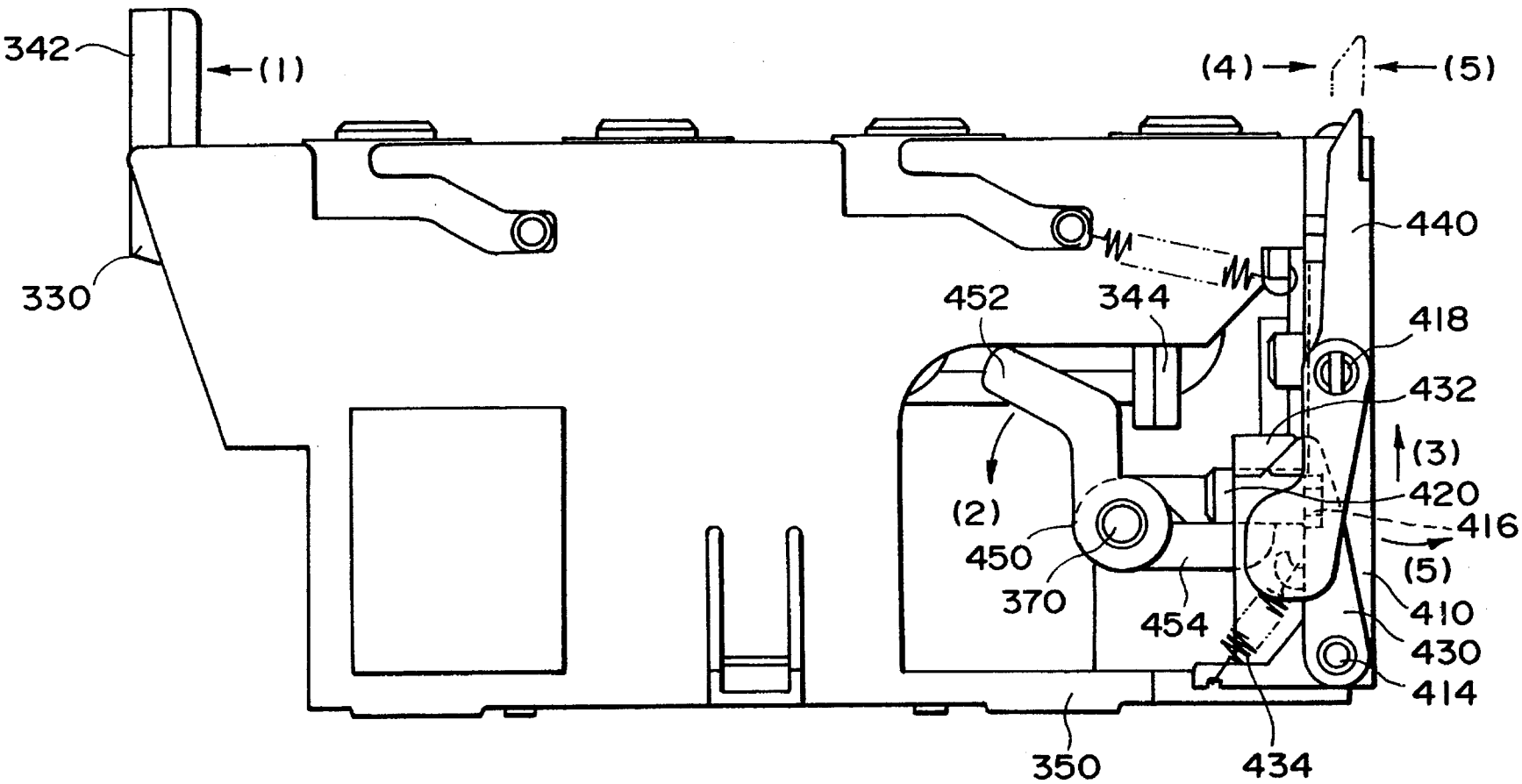
FIG. 10 illustrates a blade elevating mechanism in the structure shown in FIG. 8.

Referring to FIG. 10, the operation of the blade moving mechanism will be described. When the carriage 2 moves further to the left from its start position toward its home position, the cap holder 330 is moved in the same direction through the engaging portion 342, as described in the foregoing, as indicated by (1) in the Figure. Then, a portion 344 projected from the cap holder 330 is engaged with a first arm 352 of the cam member 450, and together with the movement, it is rotated in the counterclockwise direction about the pin 370, as designated by (2) in the Figure. The blade holder 410 is engaged with a second arm 454 of the cam member through the engaging portion 420 thereof, and therefore, by the rotation, the second arm 454 of the cam member elevates the blade holder 410, as designated by (3) in the Figure.

At this time, the releasing lever 440 is supported on the pin 418 projected from the blade holder 410, and therefore, it is elevated together. The locking lever 430 is rotatably supported on the pin 414, and it is urged by the spring 434, so that it rotates in the counterclockwise direction about the pin 414, and is elevated along the slanted surface of the stopper 432. Sooner or later, the locking lever 430 advances beyond the slanted portion of the stopper 432, and is rotated in the counterclockwise direction by the urging force of the spring 434 to be engaged to the top surface of the stopper 432, upon which the blade holder 412 is locked at the upper position. At this time, the first blade 401 is brought to and retained at the position where it is overlapped with the ejection side surface of the recording head 86. The releasing lever 440 is set at the position indicated by the broken lines, so that it becomes engageable with the carriage 2.

Thereafter, when the carriage 2 moves to the right in the Figure, the releasing lever 440 rotates in the clockwise direction by the carriage 2. However, during the rotation in that direction, it is not engaged with the locking lever 430, and therefore, the locked state is maintained, as designated by a reference (4) in the Figure. Therefore, during the movement of the carriage 2, the first blade 401 wipes the ejection outlet formed surface of the recording head 86.

When, on the contrary, the carriage 2 moves from the recording area (right side in FIG. 10), the releasing lever 440 rotates in the counterclockwise direction about the pin 418, as designated by (5) in the Figure. Then, the releasing lever 440 is rotated in the clockwise direction by the locking lever 430 about the pin 414, by which the engagement between the clocking lever 430 and the top surface of the stopper 432 is released. By this, the blade holder 412 lowers quickly by the urging force by the spring 412 (Figure 8C), so that the parts restores to the states shown in FIG. 10. Accordingly, during the leftward movement of the carriage, the first blade 401 is lowered before the recording head 86 reaches the first blade 401, and therefore, the first blade 401 does not effect the wiping operation.

Figure 11B:
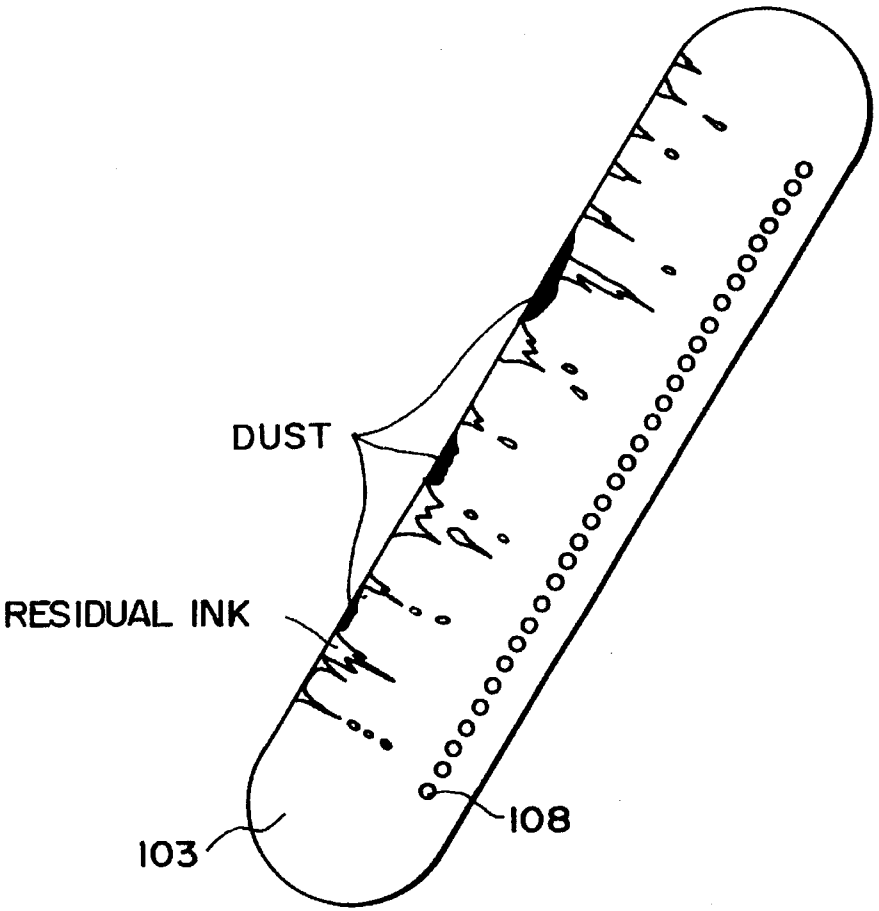
FIGS. 11A and 11B illustrate a wiping operation by the blade moved up and down by the blade elevating mechanism.
Figure 11A:
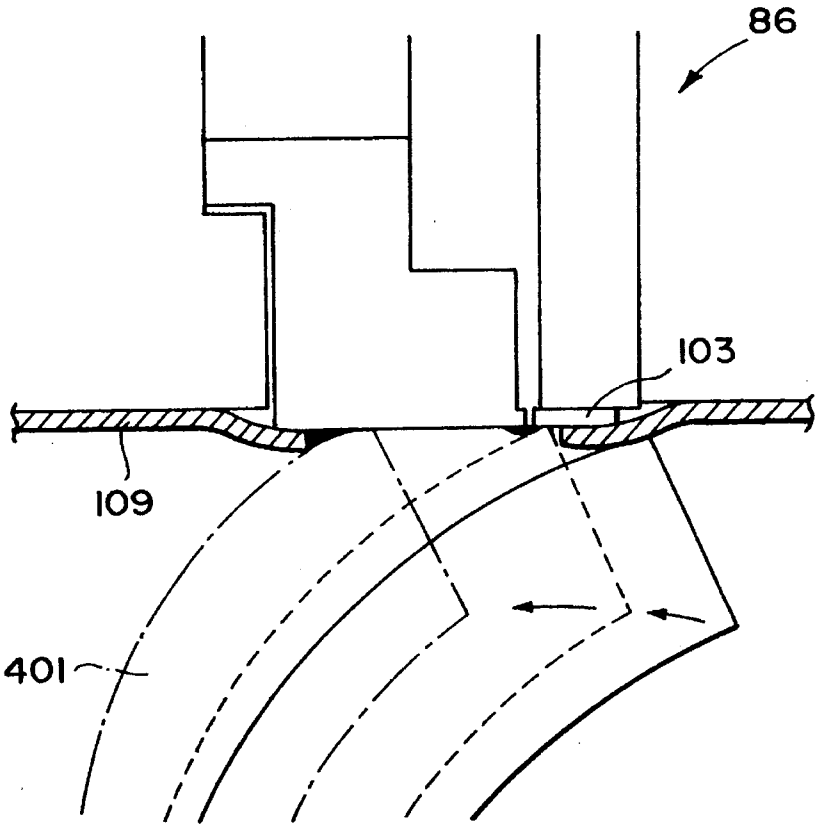

FIG. 11A is a sectional view of the blade 401 performing the wiping operation. As shown in this Figure, the wiping operation is performed in the direction from the side wherein the distance between the ejection outlets to the stopped portion is small to the side where it is large. That is, the wiping direction is the same as the shift direction of the line of the ejection outlets in the orifice plate 103. By doing so, even if the neighborhood of the ejection outlets are wet or contaminated by foreign matter, the clean ejection outlet surface is provided by the wiping to maintain the good ejection of the ink.

If the ejection surface side surface is wiped in the direction from the side where the distance between the ejection outlets and the stepped portion is larger to the smaller side, the ink or the foreign matter which is not removed completely stagnates at the stepped portion of the narrower side with the result that the orifice outlets might be clogged because the distance is smaller. Therefore, it is not preferable.

In the present embodiment, however, the first blade wipes it in the proper .direction, that is, from the narrower interval side to the larger interval side, so that even in the worst case, the ink or the foreign matter does not reach the ejection outlet position, as shown in FIG. 11B. Therefore, the ejection is not influenced, and the stabilized ejection can be maintained.

In this embodiment, the detection of the wiping is confined, as shown in FIG. 11B, and therefore, if no consideration is paid to the wiping speed, that is, the movement speed of the carriage 2, there is a possibility that the conformability of the blade 401 with the roughness of the ejection side surface of the recording head, depending on various factors such as elasticity coefficient or the like determined by the material and or the configuration of the blade 401. For example, if the first blade 401 is not able to conform with the stepped portion, and when it restores, it might already have jumped over the ejection outlets 108, which is not preferable. In this embodiment, in consideration of the various factors, the carriage 2 is moved during the wiping operation at the speed which is lower than during the normal scanning operation, so that the neighborhood of the ejection outlets is assuredly wiped.

Figure 12A:
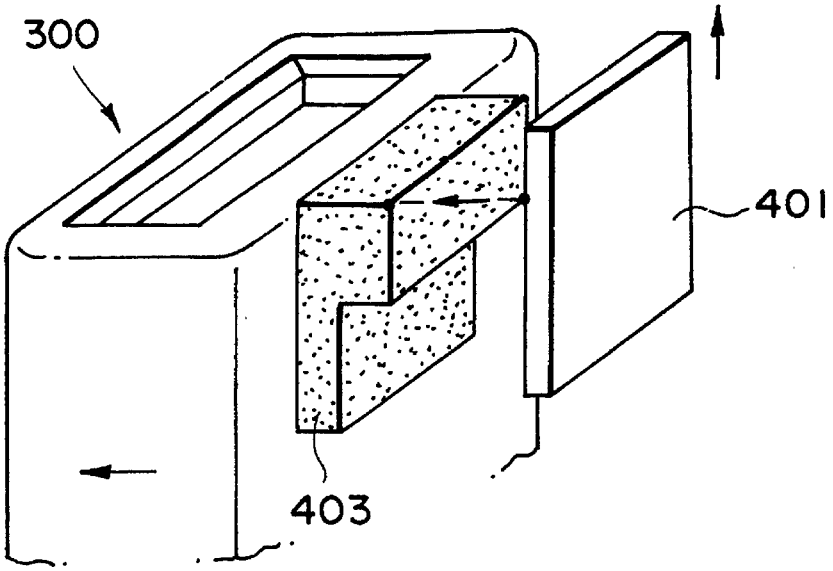
FIGS. 12A and 12B illustrate the cleaning operations for cleaning the blade.
Figure 12B:
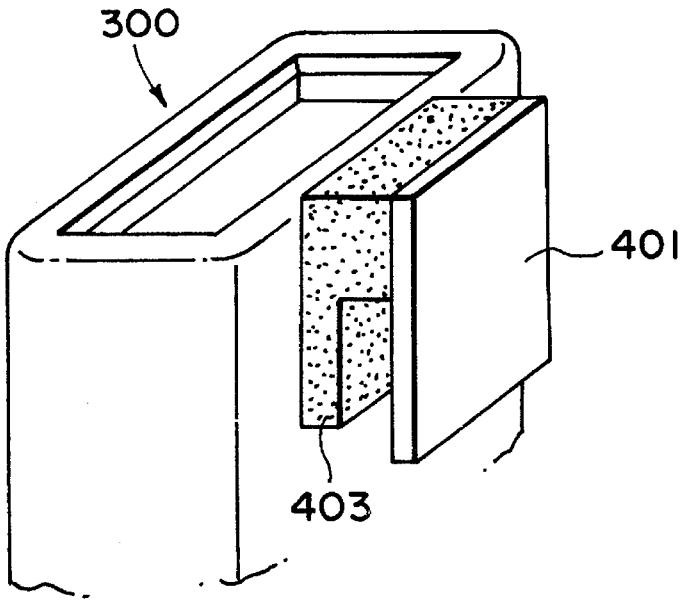

FIGS. 12A and 12B illustrate the cleaning operation by the blade 401. As described in the foregoing, together with the sliding movement of the capping unit 300, the blade 401 is elevated (Figure 12A), and thereafter, together with the rightward movement of the carriage 2, the wiping operation is performed. At this time, in this embodiment, the ink wiped out and received by the blade 401 flows only along the surface of the blade 401, so that it does not drop on the apparatus.

As shown in FIG. 12B, the blade 401 is lowered when the carriage 2 moves from the right side. A blade cleaner 403 is contacted to the blade 401 even if it is mounted on the cap unit 300, because the cap unit 300 is returned to the original position. Therefore, together with the lowering movement of the blade 401, the ink or the like deposited on the surface is all received by the cleaner 403 in the form of an absorbing member, so that the blade 401 is wiped with certainty.

(4.3) Pump Unit:

Referring to FIGS. 8B and 8C, the pump unit 500 will be described.

A regulating surface is provided on the base of the recovery unit, and is in the form of a semi-cylindrical surface. On the regulating surface, the tube 304 is wound, the tube 304 being made of flexible material at least at the portion on the regulating surface. A pressing roller 501 is rotatable about a pump shaft 504 while pressing the tube 304 to the regulating surface 50. It rotates in the direction indicated by an arrow, collapsing the tube 304, by which the vacuum is produced in the space to the cap unit 300 to suck the ink through the ejection outlet.

A guide roller 520 for rotating the pressing roller 510 is supported rotatably on the pump shaft 504. A shaft 512 of the pressing roller 510 is mounted on the guide roller 520 by the mounting member 522. A guiding partition wall 524 is mounted on the guide roller 520 as a unit to function as an anti-bouncer to maintain the tubes 304 separated. A position cam 526 is integral with the guide roller 520 to receive the driving force to rotate it. A pump driving gear train 528 includes a gear 15A on a roller 15 for feeding the recording medium (subordinate scan) and a gear meshed with a gear integral with the position cam 526. That is, in this embodiment, the driving force for driving the pump (rotation of the pressing roller) is received from the roller 15.

A leaf switch 530 is provided as detecting means to recognize the position of the roller and is actuated by a cam 532 integrally rotatable with the guide roller 520 about the pump shaft 504.

(5) Sequential Operation of the Recording Apparatus (5.1) Position Setting of the Pressing Roller:

The description will first be made as to the setting of the position of the pressing roller of the pump unit 500 for producing the sucking force for forcedly discharging the ink from the recording head 86.

Figure 13:
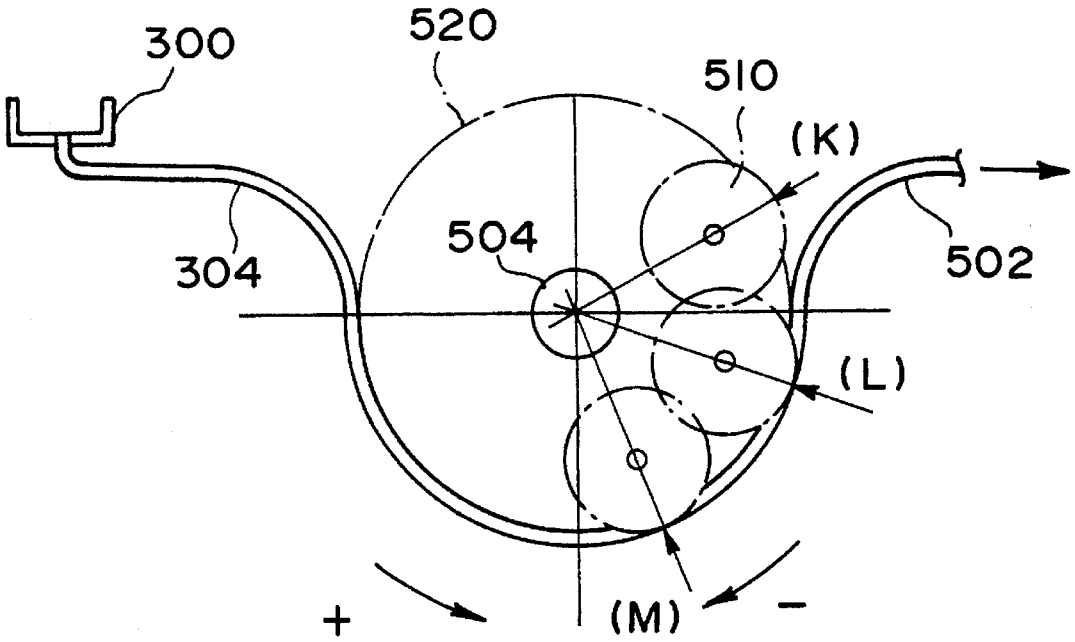
FIG. 13 illustrates an operation of an ink sucking mechanism employed in the embodiment of the present invention.

FIG. 13 illustrates this, wherein (K)–(M) are positions of the pressing roller 510. In the Figure, the counterclockwise direction (sucking direction) is indicated by "+", and the clockwise direction is indicated by "–".

At the position (K), the pressing roller 510 does not collapse the tube 304, and therefore, the inside of the cap or the ink sucking system communicates with the ambience even if the capping state is established. At the positions (L) and (M), the pressing roller 510 is stopped after it rotates in the counterclockwise direction while collapsing the tube 304 on the regulating surface 502. At those positions, the tube 304 is collapsed, so that the inside of the cap and the sucking system is isolated from the ambience when the capping state is established.

In this embodiment, there are two modes for the recovery process by the ink sucking. In one mode, the recovery process is performed by actuation of proper manual operating means or automatically. This mode is for the start after a relatively long rest period or when the ink ejection is not properly recovered even by the other recovery process such as the idle ejection or the wiping operations. In this case, the ink is not easily discharged due to increase of the viscosity or the like, and therefore, strong sucking force is applied to the ejection outlet in the cap, that is, the ink is abruptly ejected at high flow speed. This is hereinafter called "high speed recovery" or "large scale recovery". In the other mode, the ejection is improved by refreshing or cooling or the like immediately after a predetermined degree of recording operation. Particularly, in the apparatus using the thermal energy as the ejection energy, the ink temperature is high to a certain degree at this time, and therefore, the viscosity is lower, so that the ink is relatively easily charged. Therefore, the ink is ejected with smaller sucking force than in the large scale recovery. This will be hereinafter called "small force recovery" or "small scale recovery".

At the time of the large scale recovery or the small scale recovery, the pressing roller 510 rotated in the counterclockwise direction is retained at the position (L) and the position (M) for a predetermined period of time in this embodiment. The acting sucking force and the sucking amount is determined by the increase of the inside volume of the ink sucking system, that is, the inside volume corresponding to the length from the position where the counterclockwise rotated pressing roller 510 starts to collapse the tube 304 to the stop position. Therefore, the sucking force is smaller when the pressing roller 510 is stopped at the position (M) than when it is stopped at the position (L). Therefore, the ink is sucked at a lower speed through the ejection outlet in the small scale recovery than in the large scale recovery. Therefore, the state of the flow is stabilized to assuredly discharge the fine bubbles which are not easily discharged by the large sucking force because of the instability of the flow due to the turbulence or eddies. In addition, the quantity of the sucked ink is smaller, and the ink is not consumed beyond necessity.

If the reduction of the ink consumption is mainly desired, the position (L) is selected also at the small scale recovery, and the time period in which it is maintained at the position may be made smaller than in the large scale recovery. On the other hand, if it is desired that the fine bubbles or the like is assuredly removed, the rotational speed of the pressing roller 510 is decreased at the time of the small scale recovery, so that the ink is sucked at the lower speed. In this case, the consumption of the ink can be reduced, too, if the stop position is properly determined.

As for the means for forcedly discharging the ink, other means other than the sucking pump may be used, or the ink supply system to the ejection outlets may be pressurized. However, the use of the pump unit 500 as in this embodiment will make the above control or the adjustment easier.

(5.2) Position Setting of the Carriage:

Referring to FIG. 14, the description will be made as to the position setting or the like of the carriage 2. In the Figure, the positions (A)–(D) are determined with reference to a head positioned most closely to the recording region.

Figure 14A:
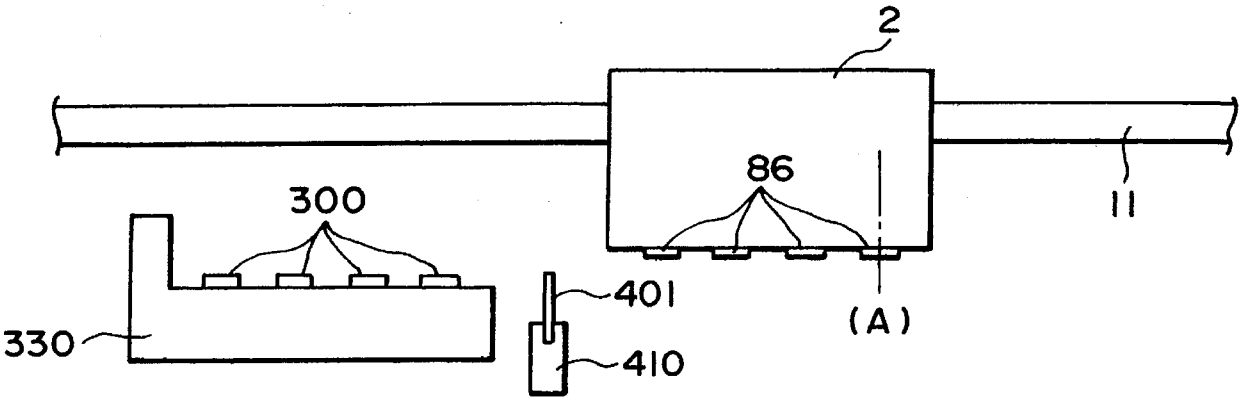
FIGS. 14A, 14B, 14C and 14D illustrate carriage positions during the recovery operation in the embodiment.

In FIG. 14A, the reverse position for the wiping operation is shown. In this embodiment, this position is the position where it is located when the capping operation is performed and when the blade 401 is elevated. In this embodiment, the capping operation and the blade projecting operations are implemented together with the movement of the carriage 2, and therefore, the transmission of the force larger than a certain extent is required from the carriage 2. Then, the carriage 2 is set at a proper position (A), and it is moved from this position to use the inertia. By doing so, the necessary and sufficient driving force for driving the above mechanism can be provided without the necessity of the increase of the size and the driving power of the motor.

Figure 14B:
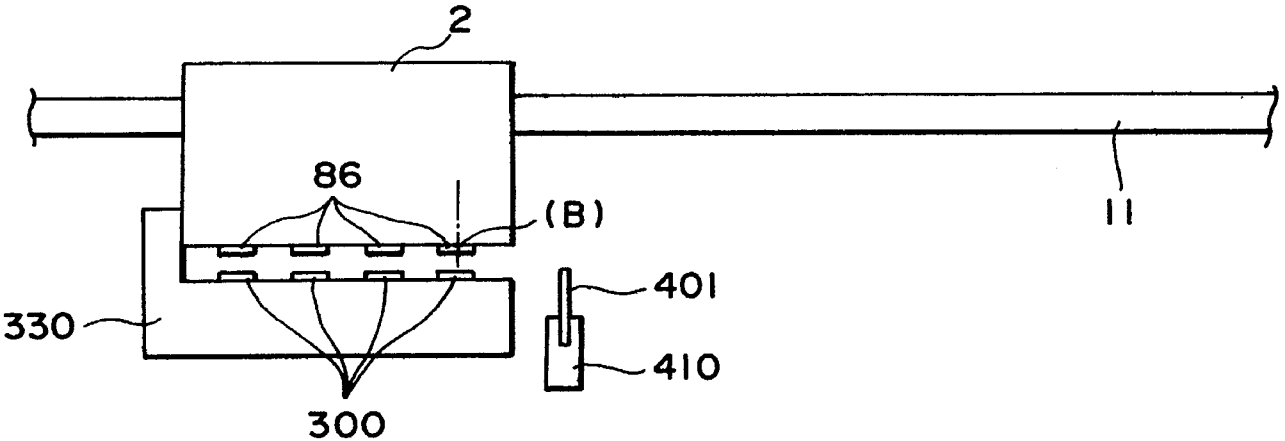

In FIG. 14B, the position (B) is a start position which is a recording operation start position and the reverse position during the recording operation. At this position, the heads 86 and caps 300 are faced, respectively. However, the cap holder 330 and the blade holder 410 are not yet driven. Therefore, the cap 300 is away from the head 86, and the blade 401 is not elevated. The idle ejection is performed in this state.

Figure 14C:
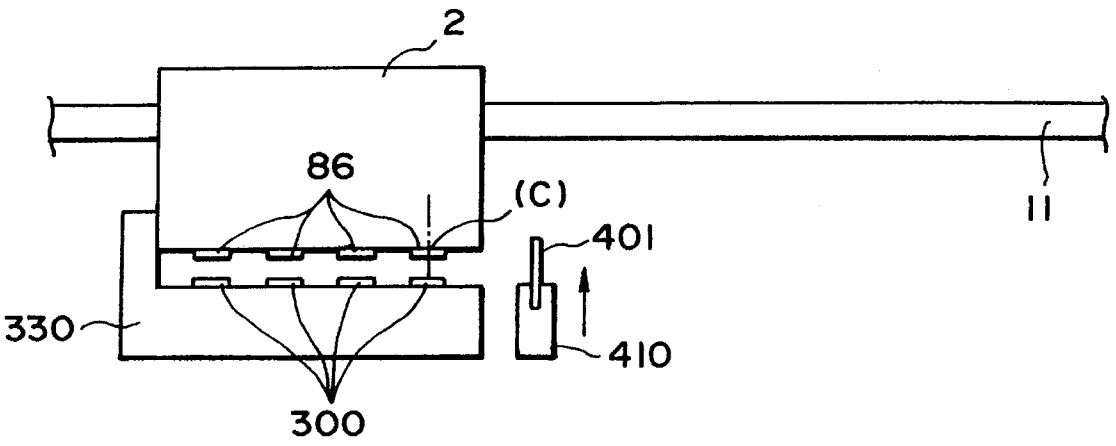
Figure 14D:
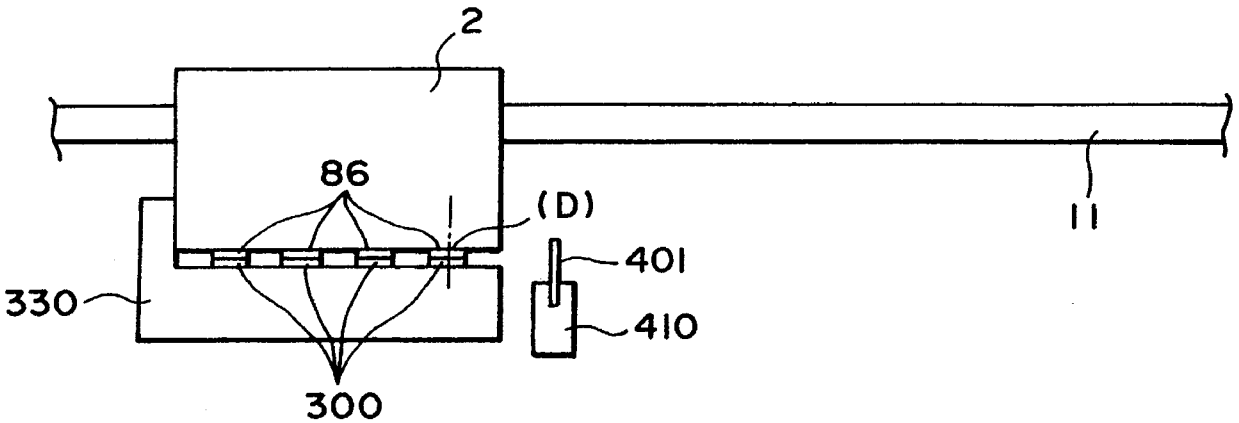

The position (C) shown in FIG. 14C is the position at which the blade holder 410 starts to rise. When the capping or the wiping is to be effected, this position is passed, or the setting is effected at this position. The position (D) in FIG. 14D is the position where the capping is effected after the cap holder 330 is raised. At this position, the large scale recovery or the small scale recovery is performed, or the apparatus is in the stand-by state.

(5.3) Summary of the Sequential Operation:

FIGS. 15A, 15B, 15C and 15D show the operational sequence in this embodiment. A column "1" represents the positions of the pressing roller 510, and column "2" represents the position of the carriage 2. The positions (K)–(M) correspond to the positions of the roller shown in FIG. 3; and the positions (A) –(D) are the same as the carriage positions shown in FIGS. 14A, 14B, 14C and 14D.

FIG. 14A shows the initial process after the main switch is actuated, and the pressing roller or the carriage position is initialized. FIG. 15B shows the state in which the copy button or the like is depressed, so that the record starting instructions are produced. After this, the recording medium is fed from the cassette or from the manual feed tray. FIG. 15C shows the wiping and/or idle ejection process performed at proper timing (each 5–10 line record scanning operations, for example) during the recording operation. FIG. 15D shows the record ending process including the small scale recovery process performed immediately after a predetermined amount of recording operation (the recording operation covering one page, in this embodiment). FIG. 15E shows the large scale process.

The details of those processes will be described hereinafter in conjunction with FIGS. 17 and 18.

Figure 16:
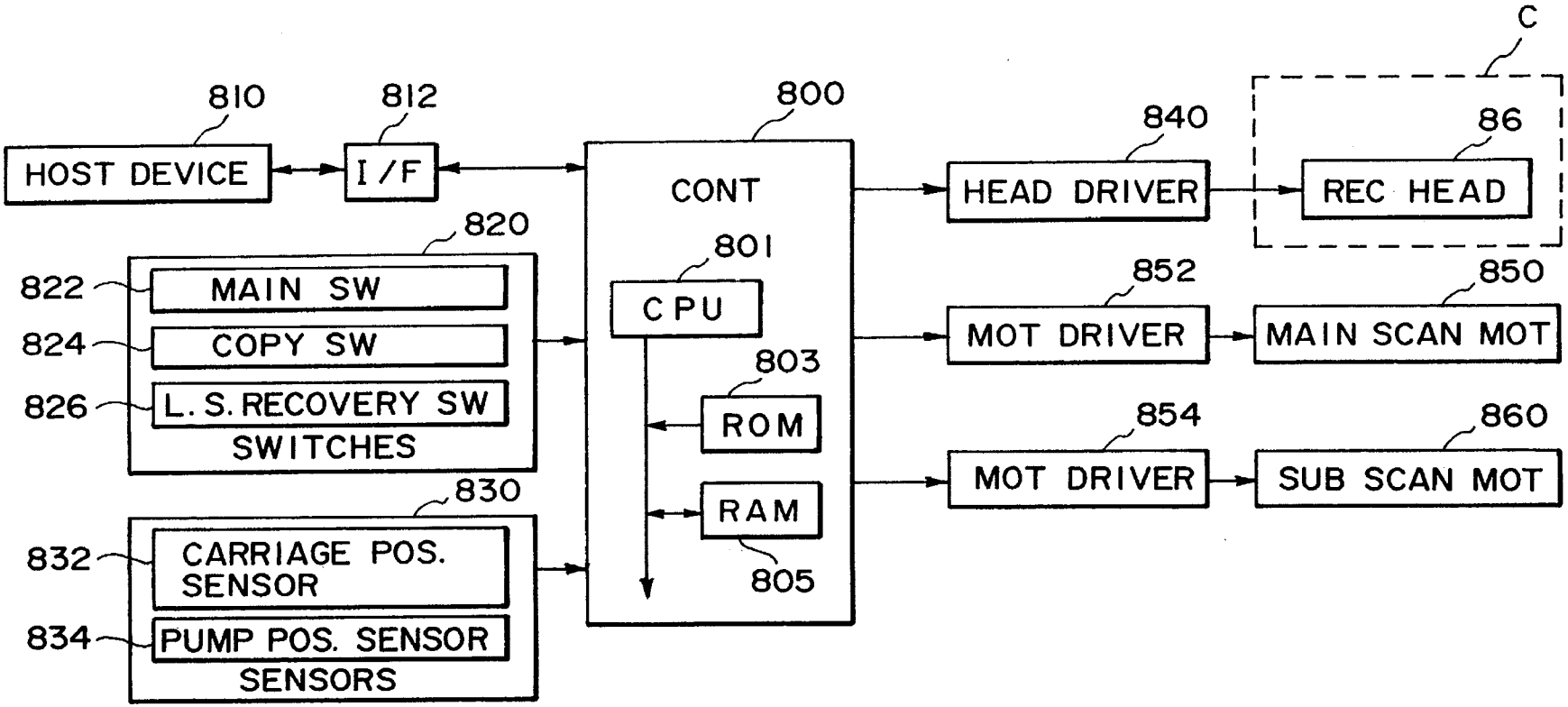
FIG. 16 is a block diagram showing an example of a structure of a control system according to an embodiment of the present invention.

(5.4) Control System:

FIG. 16 shows an example of a control system in this embodiment.

The control system includes a controller 800 which is the main portion of the control system. It includes a CPU (central processing unit) 801 in the form of a microcomputer, for example, for executing the process steps which will be shown in FIGS. 17 and 18, ROM 803 for storing the program corresponding to the process steps and fixed data, RAM 805 having an area for developing the image data and a working area, and the like.

The control system includes a host device (this may be a reader, that is, the means 212 or the like in FIG. 6) functioning as the data source for the image. The image data or the other command or status signals are transferred to and from the controller through an interface (I/F) 812.

Switches 820 are actuated by the operator to input the instructions, including a copy switch 824 for starting the recording (copying) operation, a large scale recovery switch 826 for instructing the start of the large scale recovery operation, or the like. Sensors 830 include a sensor 832 for detecting the position of the carriage 2, for example, its home position or start position or the like, a sensor 834 having the leaf switch 530 to detect the pump position, and other sensors for detecting states of the apparatus.

A head driver 840 actuates the ejection energy generating elements (electrothermal transducers in this embodiment) of the recording head in accordance with the data to be recorded. Designated by a reference 850 is a main scan motor for moving the carriage 2 in the main scan direction (the left-right direction in Figure 7); and 852 is a driver therefor. Designated by a reference 860 is a subscan motor to feed (subscan) the recording material, and it also functions to drive the pressing roller 510 through the roller 15, in this embodiment. Reference 862 designates a driver therefor.

Figure 17:
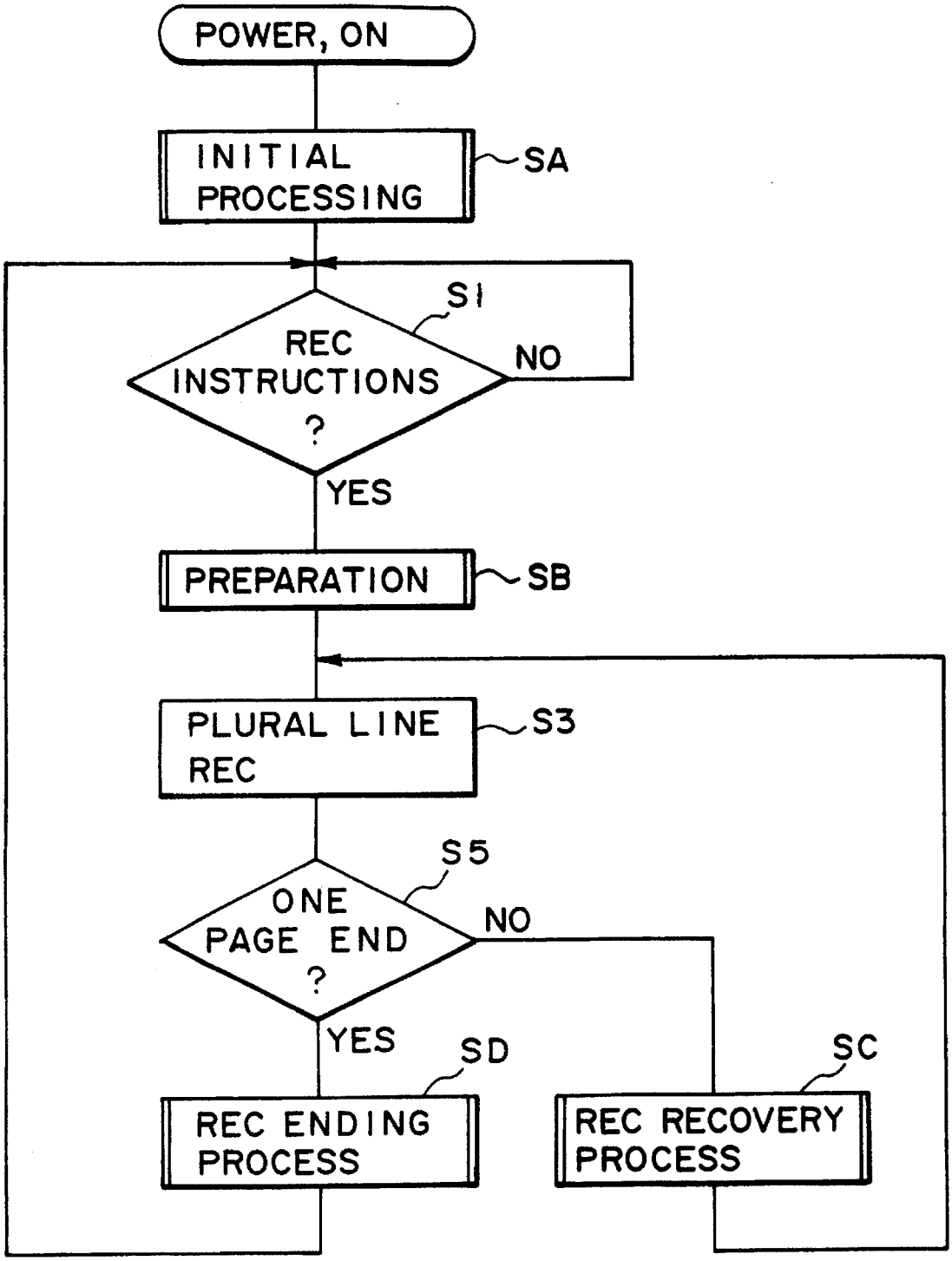
FIG. 17 is a flow chart illustrating an example of the recording operations using the control system of FIG. 16.

(5.5) Control Process:

FIG. 17 is a flow chart illustrating the recording process steps in this embodiment.

When the main switch 822 is actuated, by which the power is supplied to the apparatus, the process step starts. At step SA, the initializing process (FIG. 18A) is performed. Next, at step S1, the system waits for the copy switch 824 to be operated, for the instructions from the host device 810 to be produced, for the sheet feed signal upon the manual feed motor to be generated, and for the record start instruction signal to be generated. When these instructions are generated with the image data input from the host device 810, the preparing operation for the recording is performed at step SB, FIG. 18B.

Thereafter, at step S3, the recording operation is performed on a predetermined number of lines (in this embodiment 5–10 lines), and the discrimination is made at step S5 as to whether the record for one page is completed or not.

Figure 18A:
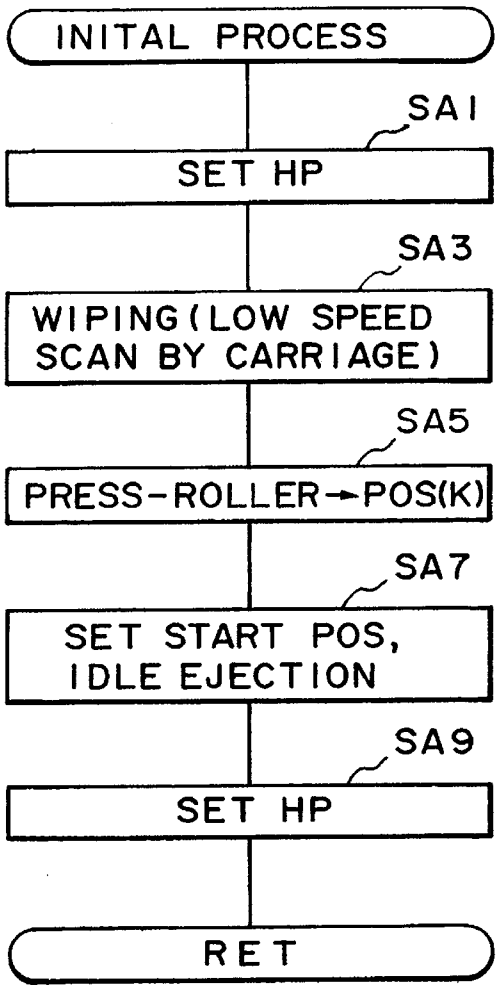
FIGS. 18A, 18B, 18C, 18D and 18E are flow charts illustrating the detailed process steps of the initial processing by the control system of FIG. 16, record preparation process, recovery process during the recording, record ending process and a large scale recovery process.
Figure 18B:
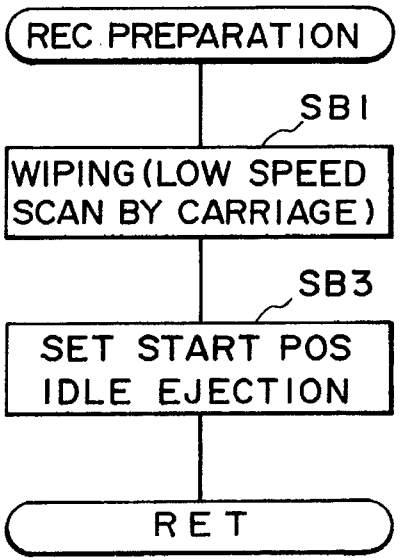
Figure 18C:
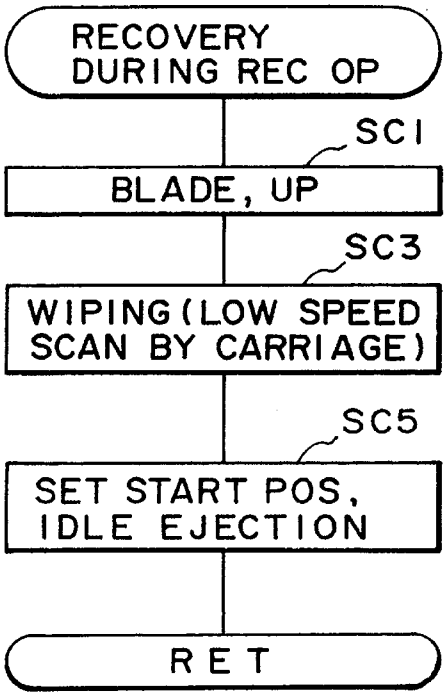

If not, the recovery operation during the recording operation is performed at step SC shown in FIG. 18C. That is, each completion of the predetermined number of line recording, one recovery process operation is carried out. If the discrimination at step S5 is affirmative, the recording ending process (FIG. 18D) is performed at step SD, and the operation returns to the step S1.

Referring to FIGS. 18A, 18B, 18C, 18D and 18E, the description will be made as to the details of the large scale recovery and the details of the steps SA, SB, SC and SD. The sequential operations shown in FIGS. 18A, 18B, 18C and 18D, correspond to Figures 15A, 15B, 15C, 15D and 15E, respectively.

As shown in FIG. 18A, during the initializing process, the carriage 2 is set to the home position (position (D)) at step SA1. At this time, the pressing roller 510 is set at the position (L). This position will hereinafter be called "home position of the roller". Upon the setting of the carriage 2 to the home position, the cap holder 330 and the blade holder 510 are also driven using the movement of the carriage 2, and therefore, the carriage 2 is placed at a proper position not interfering with the recovery unit (the position (A) of FIG. 16A, for example) to provide a pre-run distance so as to provide the proper inertia force. By the setting at the home position, the recording head 86 is capped, and the space within the cap is isolated by the sealing by the cap. At this time, the blade 401 is projected and has passed through the locking position (position. (C) of FIG. 14), and therefore, the blade 401 is at the raised position (this operation is the same as in the following). If, however the carriage 2 and the roller 510 are already at the home position, the step described in this paragraph may be skipped.

At step SA3, the carriage 2 is moved to the position (A), by which the ejection side surface of the recording head is wiped, because the blade 401 is already projected by the setting of the carriage 2 at the home position. The movement at this time is at a speed lower than a normal recording scan, as described hereinbefore, in order to assure the blade 401 to conform the stepped portions so as to assure the proper wiping operation.

At step SA5, the pressing roller 510 is rotated to the position (K), and at step SA7, the carriage 2 is set to the start position (the position (B) of FIG. 14), and at this position the idle ejection is carried out. Thus, after the wiping operation, the idle ejection (refreshing) operation is carried out. This is the same with the other processes which will be described in the following. In this embodiment, the idle ejection is effected always after the wiping. Together with the movement to the start position, the blade 401 is lowered to permit the carriage 2 to actuate the releasing lever.

The idle ejection is effective to prevent mixture of different color ink materials attributable to the wiping operation for plural recording head with a single blade. The color mixture is more conspicuous in the later wiped recording head or in the lighter shades of ink (yellow or the like). Therefore, in order to effectively prevent the color mixture, more idle ejection is carried out in the more conspicuous recording head. That is, the idle ejection process period and/or the number of idle ejections is increased for the more conspicuous recording head in the color mixture.

In this embodiment, during the idle ejections, the driving frequency for the electrothermal transducer actuation is lower (¼, for example) than the normal recording operation. This is based on the finding that the ejection side surface is less wet with the ink when the driving frequency is lower. In the idle ejection, the ejection outlets are grouped to a certain number of portions or blocks including a predetermined number (eight, for example) of ejection outlets, and the electrothermal transducers are sequentially driven for the respective blocks. It has been confirmed that by doing so, the wetting can be suppressed. These are the same as the idle ejection performed thereafter. In order to suppress the wetting, the width, a voltage level, a waveform or the like of the driving pulses may be changed in addition to or in place of changing the driving frequency. The driving scheme may also be properly determined by one skilled in the art.

After the idle ejection operation, the carriage 2 and the roller 510 are set at the home position at step SA9. Here, the carriage 2 is at first set at the home position, by which the capping is effected. At this time, the roller 510 is set at the position (K) at step SA5, and therefore, the communication with the ambience is accomplished, and therefore, no positive pressure is produced in the cap even if the volume in the cap changes upon the capping action. Thus, the air is not introduced reversely through the ejection outlets. Thereafter, the roller 510 is rotated in the clockwise direction in FIG. 13 to be placed at the position (L) (if it is rotated in the counterclockwise direction, the ink will be absorbed, which will not be preferable from the standpoint of reduction of the ink consumption). By doing so, the inside of the cap and the tube 304 is slightly pressurized, and the ink ejected by the idle ejection is not sucked but stagnates in the cap, by which the wet ambience is maintained. For these reasons, the solvent content of the ink is not easily evaporated through the ejection outlets.

When the record start operation is instructed at step S1, the preparation process shown in FIG. 18B is performed before the recording operation (step S3) is executed. In this process, the wiping operation is performed at step SB1, the wiping operation being similar to that in step SA3. Since, however, the preparation step is carried out after the home position setting of step SA9, the blade 401 is already at the raised position, the wiping is effected by the movement of the carriage 2 to the position (A). Then, similarly to the step SA7, the carriage 2 is set to the start position, where the idle ejection operation is performed. The subsequent recording operation starts always at the disposition (B).

In the recovery process during the recording operation, which is performed for each of a predetermined number of lines of recording operation, the carriage 2 is shifted to the position (C) at step SC1, and the blade holder 410 is driven to project the blade 401, as shown in FIG. 18C. Thereafter, similarly to the steps SB1 and SB3, the wiping operation (step SC3), the setting to the start position and the idle ejection operation (step SC5) are carried out. If the preparation process is performed during the interval of the recording operations to feed the recording mediums, the throughput of the record does not significantly lessen.

Figure 18D:
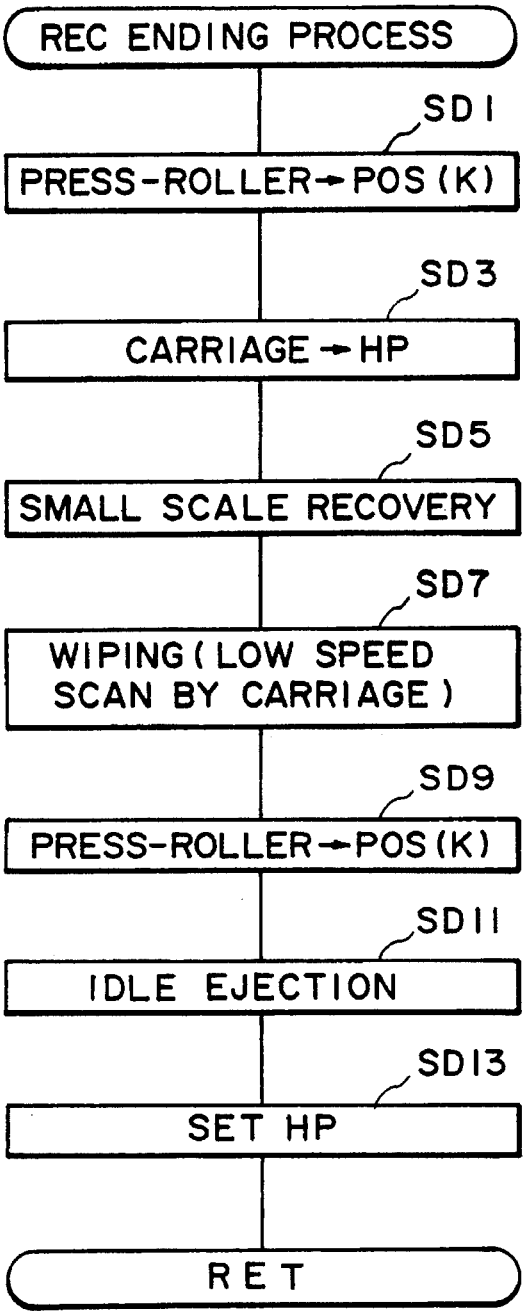

When the recording medium is discharged after one page recording, the pressing roller 510 is set continuously at the position (K) (step SD1), as shown in FIG. 18D. With this state maintained, the carriage 2 is moved to the home position at step SD3, and the capping is carried out.

Then, at step SD5 the small scale recovery operation is performed. First, the pressing roller is set at the position (M), and the position is maintained for a predetermined period of time (0.1 sec, for example) to suck the ink. Thereafter, the same operations as in steps SA3, SA5, SA7 and SA9 are carried out. The apparatus then waits for the next record start instructions while the recording head is kept capped.

Figure 18E:
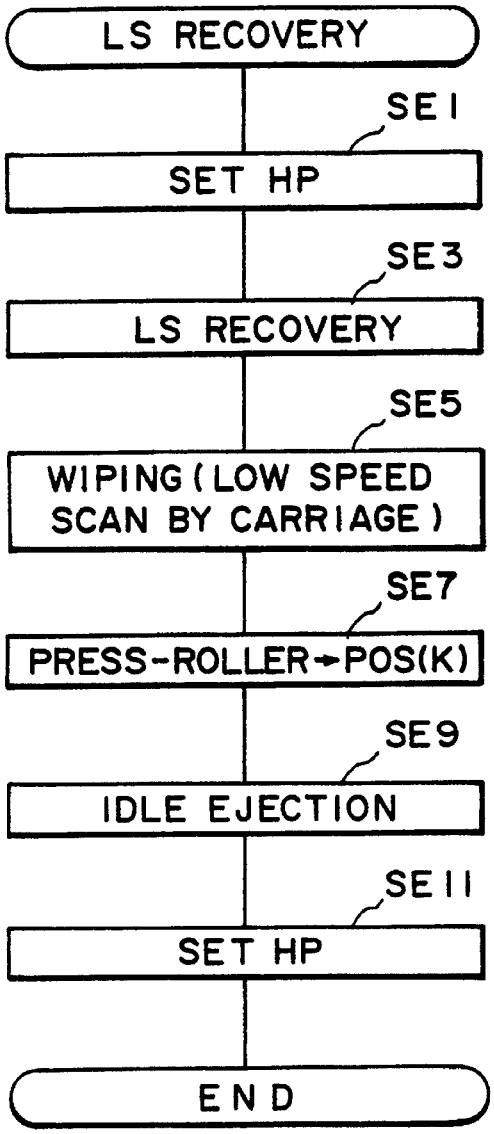

When the large scale recovery switch 826 is actuated, the process shown in FIG. 18E is started. In this process, the carriage 2 is set to the home position (position (D)) at step SE1, and the pressing roller 510 is set to its home position (position (L)). Then, the large scale recovery operation is performed at step SE3. Here, the pressing roller 510 is rotated in the counterclockwise direction and is set again at the position (L). It is retained at the position for a predetermined period of time (2–3 sec, for example) to suck the ink. Thereafter, at steps SE5, SE7, SE9 and SE11, the same operations as in the steps SA3, SA5, SA7 and SA9 in FIG. 18A are carried out. Then, the large scale recovery process ends.

Before the large scale recovery process, a process for promoting the ink discharge, such as idle ejection may be performed. By doing so, the ink consumption by the large scale recovery process is reduced. The position of the roller and the roller retaining period may be properly determined by one skilled in the art.

At the time of the wiping operation after the large scale recovery and the small scale recovery, the pressing roller 510 may be rotated in the counterclockwise direction to apply the sucking pressure with the non-capped state, by which the ink is discharged from the inside of the tube 304 to a residual ink container or the like. By doing so, no additional time is required for the discharge.

(6) Modifications:

The present invention is not limited to the embodiments described in the foregoing, but may be modified. Examples of the modifications are as follows:

In the foregoing embodiment, the recording operations for each of the lines start always at the start position (position (B)), that is, the recording operation is carried out only in one direction, but the recording operation may be carried out in both ways.

In the embodiment, the blade elevating mechanism for providing the one way wiping supports only the first blade 401, but it may support the second blade or blades 402.

In the foregoing embodiment, the blade elevating mechanism and the capping mechanism are operated using the movement of the carriage. However, additional driving source or sources may be employed. In addition, in order to more efficiently perform the idle ejections with the driving conditions determined for the respective recording heads, the recording heads may be arranged so that the recording head containing the lighter shades of ink (the color mixture is remarkable) is wiped first, thus reducing the high lightness ink consumption.

In the embodiment described in the foregoing, the sucking force for the forced discharge is changed between the large scale recovery operation and the small scale recovery operation. However, the conditions for the changing may otherwise be determined by one skilled in the art. For example, where the ink container and the recording head are contained as a unit in a cartridge, if the abrupt sucking (the large scale recovery or the like) is effected where the ink in the ink container is consumed to such an extent that the remaining amount of the ink is small, the air in the ink container may be introduced into the liquid passages in the form of bubbles. It is possible that the sucking force is reduced when the small amount of the remaining ink is detected.

In the foregoing embodiment, the recording heads are provided corresponding to the colors of the inks, but the present invention is effectively applicable to the case wherein the halftone reproduction or production is accomplished by using different lightness ink materials of the same color.

The number of recording heads may be two or more, as desired.

As described in the foregoing, according to the present embodiment, an ink jet recording apparatus having a plurality of recording heads is provided wherein the ejection recovery process conditions for the idle ejection are properly determined for the respective recording heads. Therefore, the liquid passages are refreshed, and the ink consumption is reduced, as compared with the idle ejection process all under the same conditions.

Figure 19:
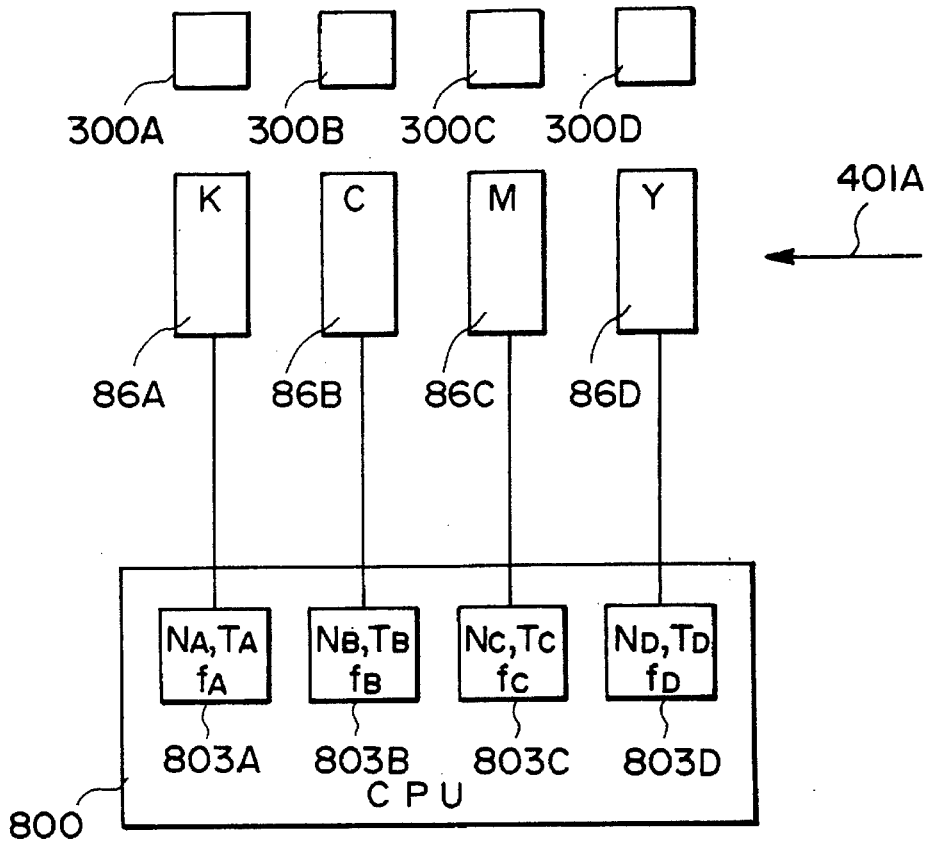
FIGS. 19, 20, 21 and 22 illustrate detailed set conditions for the idle ejections.

FIGS. 19, 20, 21 and 22 shows examples of different idle ejection conditions selected. In this example, the recording heads 86*a*, 86*b*, 86*c* and 86*d* are ink jet recording heads containing black ink K, cyan ink C, magenta ink K and yellow ink Y, respectively. FIG. 19 shows the start position where the idle ejection is carried out. By the movement of each of the recording heads in the direction indicated by an arrow 401A, the recording head is cleaned by an unshown cleaning means, and then is moved to the recording region (left side). Therefore, the idle ejection after the cleaning is performed when the recording heads 86*a*– 86*d* are returned to the FIG. 18 position in the direction opposite to the direction of the arrow 401A after the recording heads 86*a*, 86*b*, 86*c* and 86*d* are cleaned in the order named. As shown in FIG. 19, caps 300*a*, 300*b*, 300*c* and 300*d* are faced to the respective recording heads 86*a*, 86*b*, 86*c* and 86*d* with gaps, respectively in the caps. Unshown ink absorbing materials are accommodated therein. Central control means (CPU) 800 includes as the above-described ROM 803 ROM elements 803*a*, 803*b*, 803*c* and 803*d* exclusively for the recording heads 86*a*, 86*b*, 86*c* and 86*d*. In the ROM elements 803*a*, 803*b*, 803*c* and 803*d*, the idle ejection numbers NA–ND, ejection period TA–TD and the idle ejection frequency fA–fD are preset, or stored in a changeable manner. With this structure, the recording medium first receives the black ink, and thereafter, it receives another ink thereon or adjacent thereto, and therefore, the spread of the ink on the recording medium is minimized as compared with the structure in which the black ink is ejected afterward. In this embodiment, the advantage can be maintained for long period, and is therefore particularly effective to this structure.

As for the idle ejection, there are known an initial idle ejection to maintain good stand-by state after actuation of the main switch and an idle ejection during the recording for the purpose of reduction of the ink viscosity and decrease of the ink temperature. It is known to employ different ejection conditions for the two types of idle ejection operations. However, the present invention provides different idle ejection conditions for one or more of the plural recording heads.

The difference in the idle ejection conditions for the respective heads may be determined in consideration of (A) the occurrence of different color ink material mixture by the cleaning process after the sucking recovery process, or (B) the different color ink material mixture by the cleaning after the printing operation. It is preferable that one of the above (A) and (B) are taken into consideration with respect to the initial idle ejection (normal idle ejection) and the during-recording idle ejection.

The reason is that as compared with the normal idle ejection, the different color ink mixture occurs more easily if it is carried out after the cleaning operation, and therefore, the number of idle ejections or the ejection period may be preferably increased in the cases (A) and (B). Since the discharged ink which can result in the different color ink mixture is larger in the quantity in the case (A) than in the case (B), it is preferable that the idle ejection conditions are enhanced.

Figure 20:
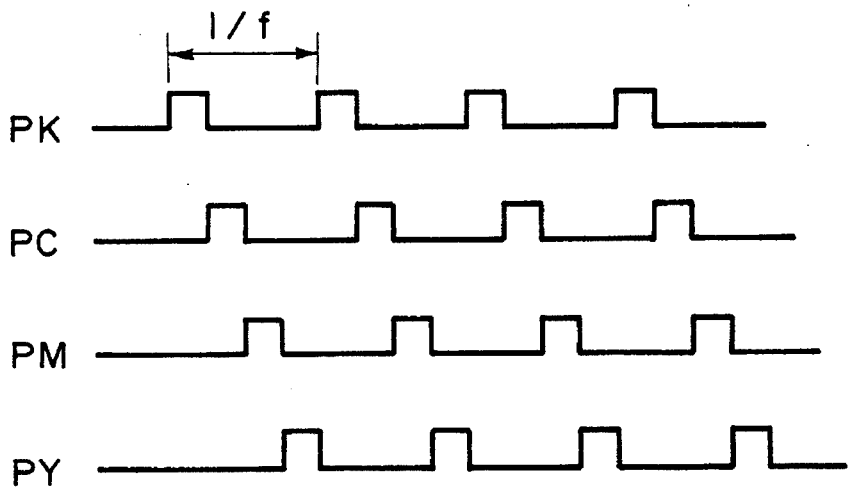

Referring to FIG. 20, the example in which the idle ejection conditions are different for the recording heads will be described. It is preferable that the above described conditions are satisfied.

FIG. 20 shows an example which is intended to reduce the power consumption and to accomplish the assured idle ejections for plural recording heads. To accomplish them, the black ink idle ejection pulse PK, the cyan ink idle ejection pulse PC, the magenta ink idle ejection pulse PM, the yellow ink idle ejection pulse PY are not produced simultaneously, but are produced with delay.

In this Figure, the frequency f is small relative to the driving frequency of the recording head (solid image printing frequency). Preferably, it is one half of the record driving frequency. In this example, the record driving frequency is 4 KHz, and the idle ejection frequency f is 2 KHz. By selecting in this manner, the ink does not fall during the idle ejection operation after the cleaning operation. In the idle ejection operation, it is preferable that the temperature control means (not shown) of the recording head continues to be operated. This is effective to maintain good operation of the idle ejection and also to assuredly discharge the unnecessary ink. The temperature controlled by the control means is preferably higher than the temperature during normal stand-by state, further preferably, it is equivalent to the temperature level maintained during the normal recording operation. In this example, the temperature is maintained 20° C., 25° C. and 25° C. during the standby state, during the recording operation and during the idle ejection operation, respectively.

Figures 21, 22:
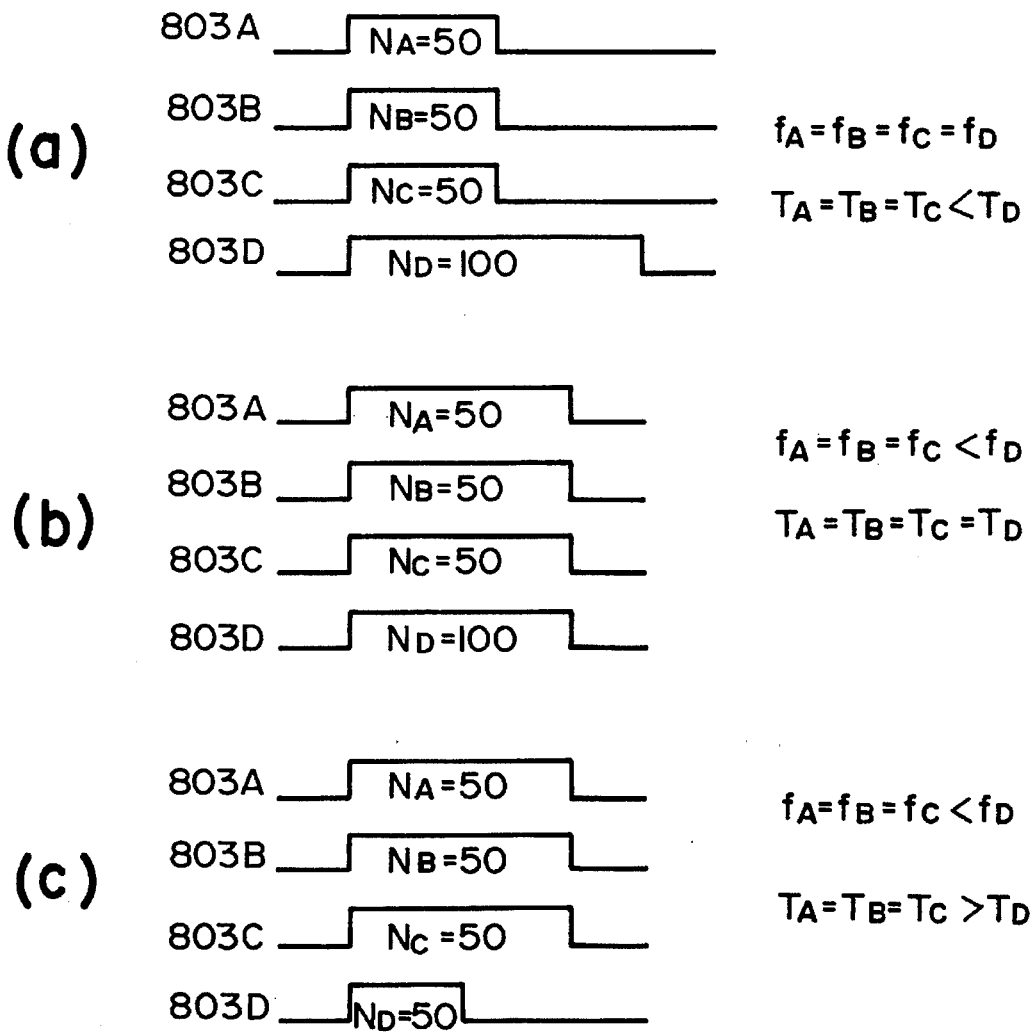

Referring to FIG. 21, the description will be made as to the idle ejection number. When the cleaning operation is carried out in the direction from the black ink K, cyan ink C, magenta ink M and yellow ink Y, the ink in the later cleaned recording head, particularly, the last cleaned recording head 86*d* is more influenced than the initially cleaned recording head 86*a*. That is, the amount of the mixture of the ink is large. In Example 1, the number ND of the idle ejections for the recording head 86*d* is 100, the numbers thereof for the other recording heads are 50. By doing so, the idle ejection operation is performed properly for the respective recording heads without wasteful idle ejections. In Example 2, the sequentially increasing ink mixture is dealt with by sequentially increasing the numbers of the idle ejections in the order of the cleaning. In the Example 2, the numbers are 50, 60, 80 and 100 with better results. Example 3 is particularly directed to the problem arising when the black ink is mixed into the other ink. The number of idle ejections for the recording heads 86*b*–86*d* are twice (100) the number for the recording head 86*a*. It is effective irrespective of the order of the cleaning operations to provide the different idle ejection condition for the black ink recording head than for the other recording head (including less density black ink recording head, if any).

FIG. 22(*a*) shows the detail of the Example 1 shown in FIG. 21. The idle ejection conditions are such that the frequencies fA–fD are the same, and the ejection periods TD is longer corresponding to the larger idle ejection number ND. In this example, only the recovery process period for the recording head 86*d* is increased, and therefore, the throughput of the recording is decreased, and therefore, not quite preferred.

The example of FIG. 22(*b*) improves this point, by increasing the pulse frequency fD of the idle ejection for the recording head 86*d* to significantly reduce the difference among the plural recording heads, thus reducing the entire idle ejection period. In this example, the frequency fD is doubled to make the total period (TA–TD) remains unchanged.

The example of FIG. 22(*c*) is such that the frequency fD is further increased. According to this example, although the number of the idle ejections are equivalent between the recording head required to be subjected to the maximum idle ejection operation and the other recording head, but the idle ejections are concentrated within a shorter period, by which the different color ink is prevented from introducing into the common chamber. By the efficient idle ejections, the example of FIG. 22(*c*) has remarkably enhanced the recovery effects.

By employing the same pulse numbers NA–ND, the pulse generating circuit or the like can be produced less costly.

In FIGS. 22, (*a*)–(*c*), the pulses are shown schematically without showing the number of pulses, that is, the number of idle ejections very correctly. Actually, however, they are plural pulses synchronized with the associated recording heads, or the pulses shown in FIG. 20.

In this manner, the idle ejection conditions may be properly determined according to the present invention by properly selecting the frequency, the number of ejections, the operating period and/or the like.

In the above-described cases (A) and (B), the conditions may be used to provide the good ejections within the scope of the present invention.

The recovery process may be performed repeatedly.

In the foregoing embodiment, the wiping operation is performed during the movement of the recording head, the wiping may be performed by the movement of the blade.

The present invention is not limited to the serial type printer, but is applicable to a line printer in which the ejection outlets are formed over the entire width of the recording medium.

The present invention is particularly suitably usable in a bubble jet recording head and recording apparatus developed by Canon Kabushiki Kaisha, Japan. This is because, the high density of the picture element, and the high resolution of the recording are possible.

The typical structure and the operational principle of preferably the one disclosed in U.S. Pat. Nos. 4,723,129 and 4,740,796. The principle is applicable to a so-called on-demand type recording system and a continuous type recording system particularly however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provide by the electrothermal transducer to produce film boiling on the heating portion of the recording head, whereby a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as disclosed in U.S. Pat. No. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents, In addition, the present invention is applicable to the structure disclosed in Japanese Laid- Open Patent Application Publication No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because, the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and a plural recording head combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of the recovery means and the auxiliary means for the preliminary operation are preferable, because they can further stabilize the effect of the present invention. As for such means, there are capping means for the recording head, cleaning means therefor, pressing or sucking means, preliminary heating means by the ejection electrothermal transducer or by a combination of the ejection electrothermal transducer and additional heating element and means for preliminary ejection not for the recording operation, which can stabilize the recording operation.

As regards the kinds of the recording head mountable, it may be a single corresponding to a single color ink, or may be plural corresponding to the plurality of ink materials having different recording color or density. The present invention is effectively applicable to an apparatus having at least one of a monochromatic mode mainly with black and a multi-color with different color ink materials and a full-color mode by the mixture of the colors which may be an integrally formed recording unit or a combination of plural recording heads.

Furthermore, in the foregoing embodiment, the ink has been liquid. It may be, however, an ink material solidified at the room temperature or below and liquefied at the room temperature. Since in the ink jet recording system, the ink is controlled within the temperature not less than 30° C. and not more than 70° C. to stabilize the viscosity of the ink to provide the stabilized ejection, in usual recording apparatus of this type, the ink is such that it is liquid within the temperature range when the recording signal is applied. In addition, the temperature rise due to the thermal energy is positively prevented by consuming it for the state change of the ink from the solid state to the liquid state, or the ink material is solidified when it is left is used to prevent the evaporation of the ink. In either of the cases, the application of the recording signal producing thermal energy, the ink may be liquefied, and the liquefied ink may be ejected. The ink may start to be solidified at the time when it reaches the recording material. The present invention is applicable to such an ink material as is liquefied by the application of the thermal energy. Such an ink material may be retained as a liquid or solid material on through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus comprising:

a recording means for recording, said recording means having a plurality of different groups of recording portions, each of said groups having an ink with a different property, each of said recording portions of said groups comprising:

at least one ink outlet, at least one liquid passage communicating with said ink outlet and passing said ink and at least one ejection energy generating element communicating with said at least one liquid passage for generating energy for ejecting said ink through said ink outlet;

refreshing means for performing a refreshing operation on each of said recording portions to refresh the ink in said liquid passage thereof by driving said ejection energy generating element to eject the ink when a recording operation of said apparatus is not performed, wherein all of said recording portions undergo the refreshing operation substantially simultaneously; and controlling means for controlling said refreshing means to provide a driving condition for said ejection energy generating element of each of said recording portions, wherein the driving condition during said refreshing operation for each of said plurality of different groups of said recording portions is predetermined independently based on said property of the ink.

2. An apparatus according to claim 1, further comprising:

a wiping member for sequentially wiping a surface of each of said recording portions in which said ink outlet is formed;

moving means for effecting relative movement between said recording portions and said wiping member, said wiping being performed as a result of said relative movement, wherein said controlling means controls said refreshing means to drive a larger number times said ejection energy generating element of one of said recording portions wiped by said wiping member after another of said recording portions.

3. An apparatus according to claim 1, further comprising:

a wiping member for sequentially wiping a surface of each of said recording portions in which said ink outlet is formed;

moving means for effecting relative movement between said recording portions and said wiping member, said wiping being performed as a result of said relative movement, wherein said recording portions eject inks that differ in shades of lightness and said controlling means controls said refreshing means to drive said ejection energy generating element of one of said recording portions using a relatively lighter shade of ink a larger number of times than said ejection energy generating element of another of said recording portions using a relatively darker shade of ink.

4. An apparatus according to claim 1, 2 or 3, wherein each said ejection energy generating element comprises at least one electrothermal transducer for generating thermal energy for ejecting said ink through said ink outlet.

5. An ink jet recording apparatus according to claim 1, further comprising discharging means for forcibly discharging said ink through said ink outlet by applying pressure to the ink in said liquid passage and control means for controlling an amount of tale pressure and period of time of application of the pressure.

6. An apparatus according to claim 5, wherein said discharging means includes a pump for sucking ink from said ink outlet of at least one of said recording portions.

7. An apparatus according to claim 6, wherein said control means includes means for actuating said discharging means when said apparatus is in a stand-by state in which a recording operation has not been performed for a relatively long time and means for actuating said discharging means a relatively short time after completion of a recording operation, wherein the amount of the pressure or the period of time of application of the pressure is lower for the actuation a relatively short time after completion of the recording operation than for the actuation in the stand-by state.

8. An apparatus according to claim 5, wherein each said ejection energy generating element comprises at least one electrothermal transducer for producing thermal energy for ejecting ink through said ink outlet.

9. An apparatus according to claim 1, wherein said controlling means changes a number of ejection energy generating elements being driven for each group of said groups of recording portions, wherein said number of ejection energy generating elements is the driving condition.

10. An apparatus according to claim 1, wherein said controlling means changes a frequency at which a corresponding number of ejection energy generating elements are driven for each group of said groups of recording portions, wherein said frequency is the driving condition.

11. An apparatus according to claim 1, wherein said controlling means changes a duration that a corresponding number of said ejection energy generating elements are driven for each group of said groups of recording portions, wherein said duration is driving condition.

12. An apparatus according to claim 1, wherein each of said groups of recording portions ejects an ink of a different color.

13. An apparatus according to claim 1, wherein the driving condition of at least one of said groups is different from at least one other of said groups of recording portions.

14. An apparatus according to claim 1, wherein said recording portions of said groups have ejection outlets for ejecting inks having different properties.

* * * * *

UNITED STATES PATENT AND TRADEMARK OFFICE

CERTIFICATE OF CORRECTION

PATENT NO. : 5,495,271

DATED : February 27, 1996

INVENTOR(S) : NORIFUMI KOITABASHI ET AL.

It is certified that error appears in the above-identified patent and that said Letters Patent is hereby corrected as shown below:

COLUMN 1

Line 54, "GB2, 169,855A" should read --GB2169855A--.

COLUMN 2

Line 6, "forced" should read --forced recovery--.
Line 26, "materials," should read --materials--.
Line 30, "shade);" should read --shade), this effect--.

COLUMN 5

Line 22, "link 2," should read --link 21,--.
Line 63, "carriage" should read --carriage,--.

COLUMN 6

Line 3, "distance," should read --distance l--.
Line 52, "1101" should read --101--.
Line 53, "1101" should read --101--.
Line 60, "1101" should read --101--.
Line 67, "are faced" should read --is faced--.

COLUMN 7

Line 65, "a" should be deleted.

COLUMN 8

Line 57, "(FIG. 8A," should read --(FIG. 8A),--.

UNITED STATES PATENT AND TRADEMARK OFFICE

CERTIFICATE OF CORRECTION

PATENT NO. : 5,495,271

DATED : February 27, 1996

INVENTOR(S) : NORIFUMI KOITABASHI ET AL.

It is certified that error appears in the above-identified patent and that said Letters Patent is hereby corrected as shown below:

COLUMN 10

Line 51, "clocking" should read --locking--.
Line 55, "restores" should read --restore--.
Line 67, "are" should read --is--.

COLUMN 13

Figure 15A:
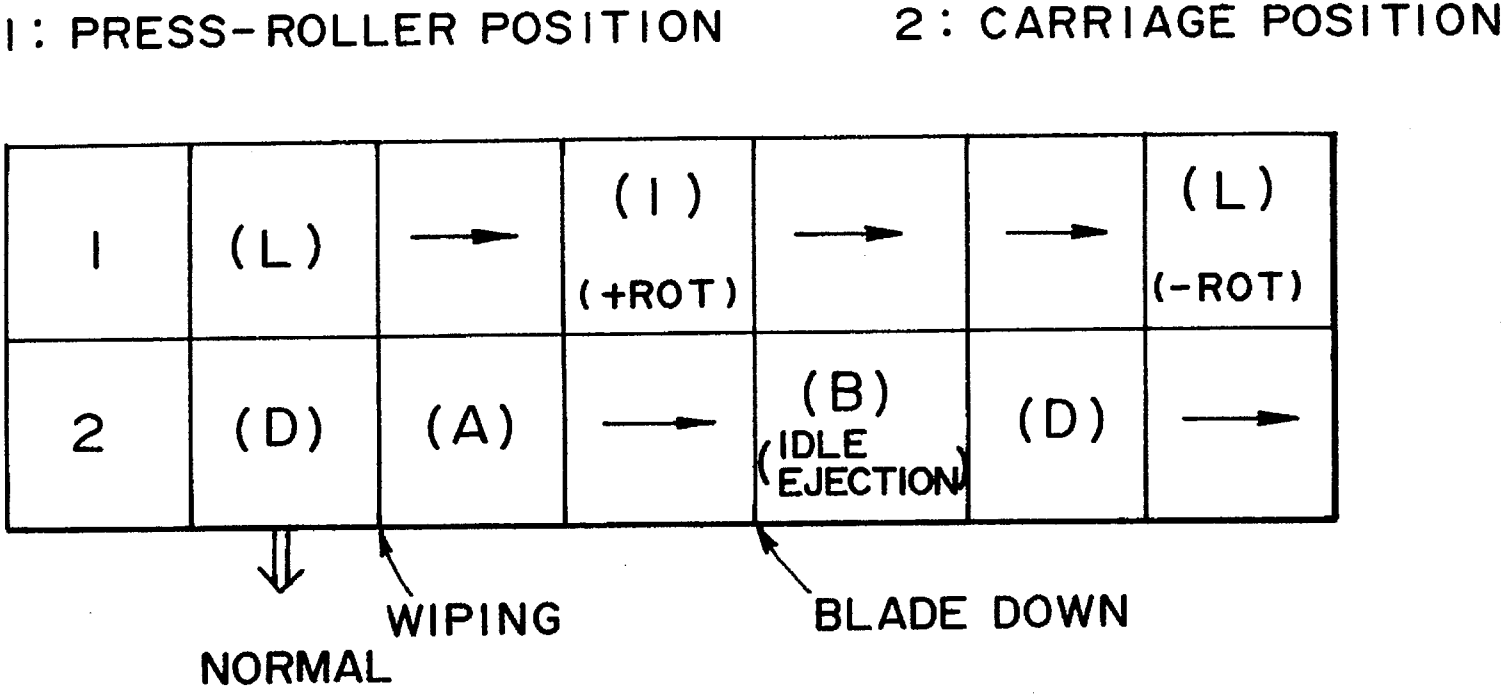
FIGS. 15A, 15B, 15C, 15D and 15E illustrate the relation between the ink sucking mechanism of FIG. 13 and the position of the carriage of FIG. 14 during the sequential operation being performed in accordance with the present invention.
Figure 15B:
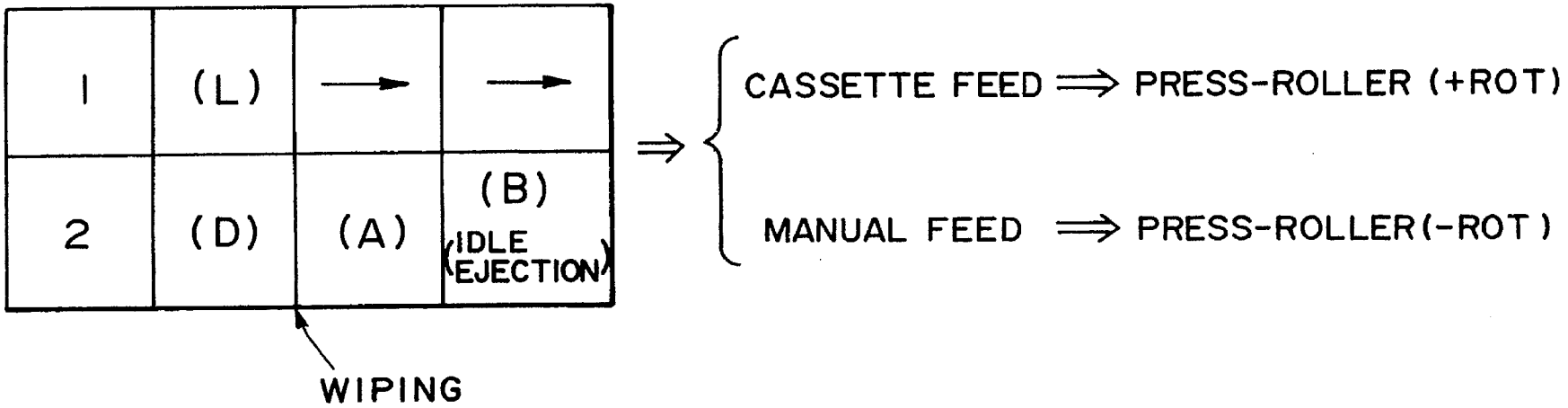
Figure 15C:
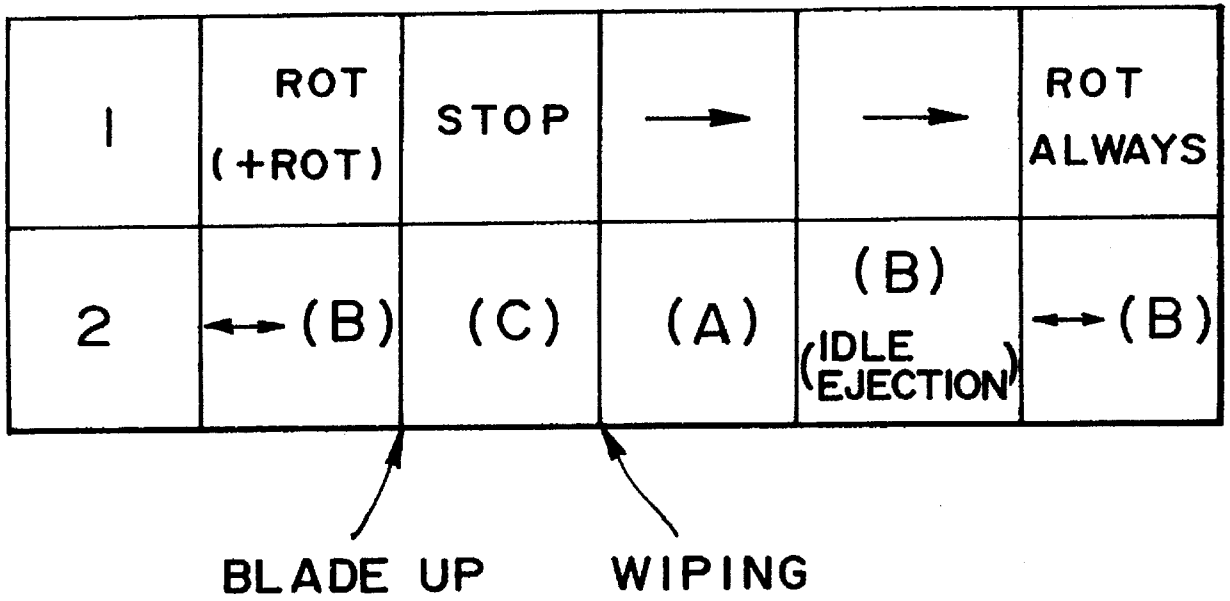
Figure 15D:
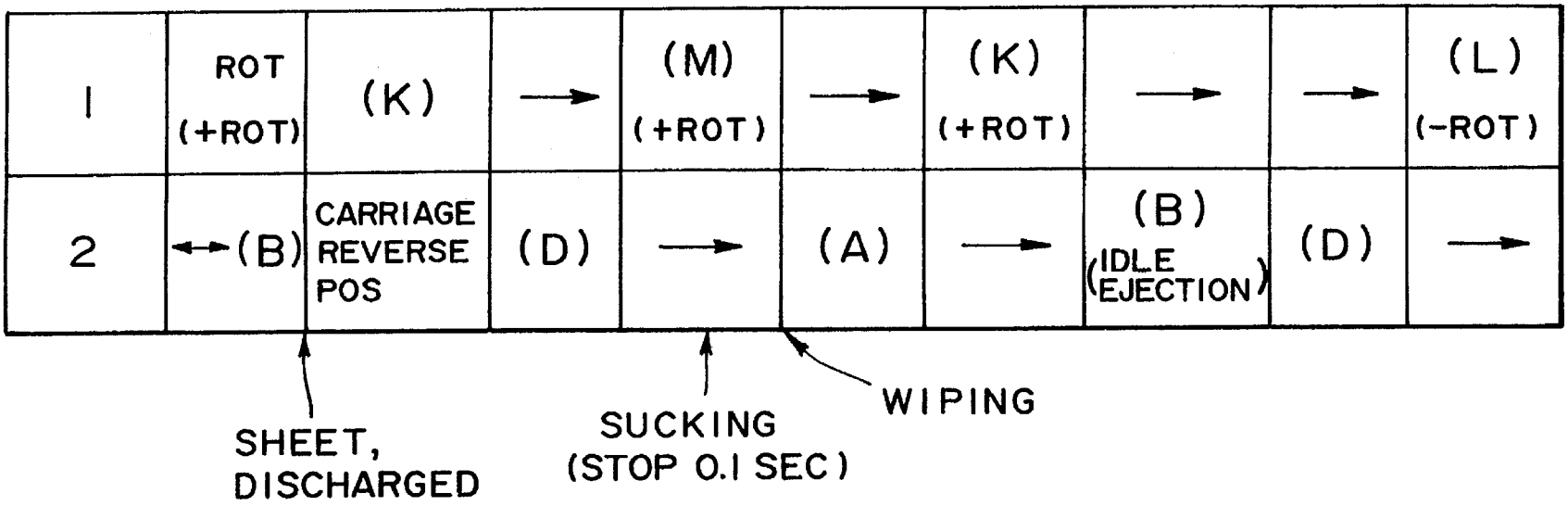
Figure 15E:
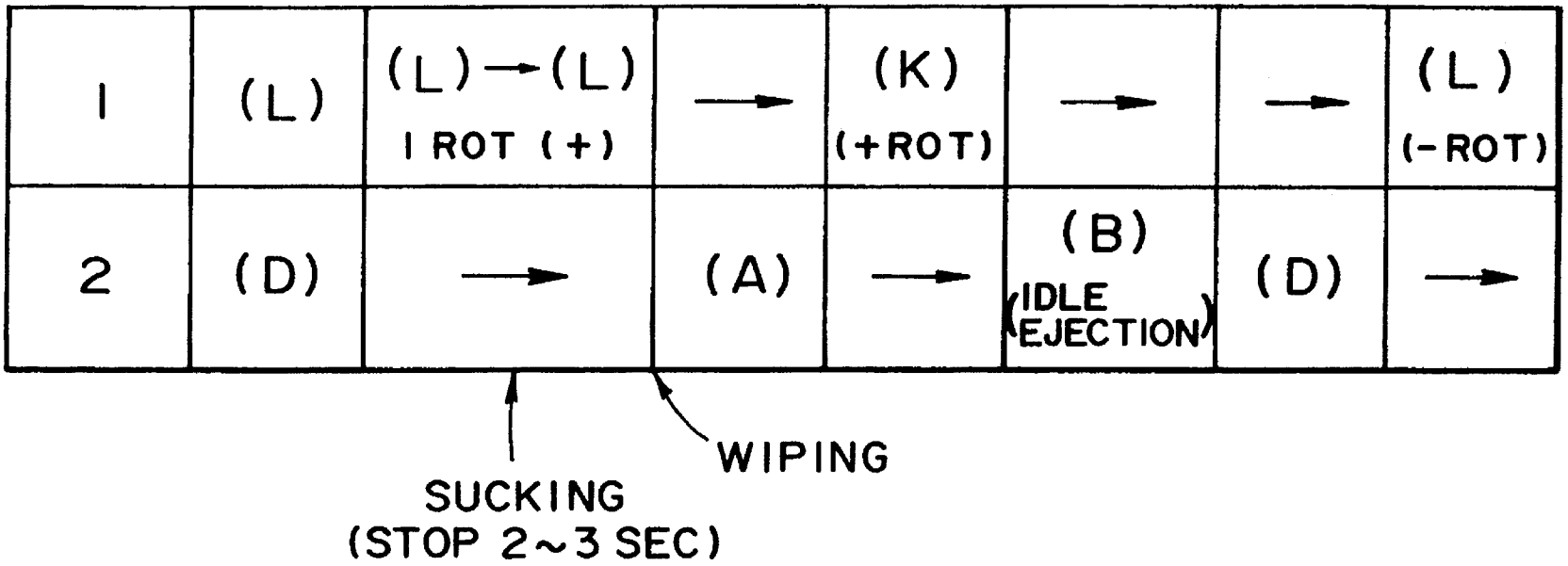

Line 65, "FIG. 14A" should read --FIG. 15A--.

COLUMN 15

Line 23, "16A," should read --14A,--.
Line 30, "however" should read --however,--.
Line 53, "head" should read --heads--.

COLUMN 16

Line 40, "disposition (B)." should read --position (B).--.

COLUMN 17

Line 42, "shades" should read --shade--.
Line 43, "high lightness" should read --lighter shade--.

UNITED STATES PATENT AND TRADEMARK OFFICE

CERTIFICATE OF CORRECTION

PATENT NO. : 5,495,271

DATED : February 27, 1996

INVENTOR(S) : NORIFUMI KOITABASHI ET AL.

It is certified that error appears in the above-identified patent and that said Letters Patent is hereby corrected as shown below:

COLUMN 18

Line 6, "shows" should read --show--.
Line 9, "magenta ink K" should read --magenta ink M--.
Line 22, "respectively" should read --respectively,--.
Line 35, "long" should read --a long--.
Line 61, "the quantity" should read --quantity--.

COLUMN 19

Line 23, "maintained" should read --maintained at--.
Line 64, "remains" should read --remain--.

COLUMN 20

Line 25, "head, the" should read --head, and the--.
Line 36, "of" should read --is--,.
Line 40, "system" should read --system;--.
Line 46, "provide" should read --provided--.
Line 57, "No." should read --Nos.--.
Line 66, "patents," should read --patents.--.

COLUMN 21

Line 38, "multi-color" should read--multi-color mode--.

COLUMN 22

Line 19, "ink" should read --ink,--.
Line 46, "number" should read --number of--.

UNITED STATES PATENT AND TRADEMARK OFFICE

CERTIFICATE OF CORRECTION

PATENT NO. : 5,495,271

DATED : February 27, 1996

INVENTOR(S) : NORIFUMI KOITABASHI ET AL.

It is certified that error appears in the above-identified patent and that said Letters Patent is hereby corrected as shown below:

COLUMN 23

Line 7, "tale" should read --the--.

COLUMN 24

Line 14, "driving" should read --the driving--.

Signed and Sealed this

Third Day of September, 1996

*Attest:*

*Attesting Officer*

BRUCE LEHMAN

*Commissioner of Patents and Trademarks*